US010596804B2

(12) United States Patent
Landa et al.

(10) Patent No.: US 10,596,804 B2
(45) Date of Patent: Mar. 24, 2020

(54) INDIRECT PRINTING SYSTEM

(71) Applicant: LANDA CORPORATION LTD., Rehovot (IL)

(72) Inventors: Benzion Landa, Nes Ziona (IL); Aharon Shmaiser, Rishon LeZion (IL); Alon Siman-Tov, Or Yehuda (IL); Alon Levy, Rehovot (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 15/556,324

(22) PCT Filed: Mar. 20, 2016

(86) PCT No.: PCT/IB2016/051560
§ 371 (c)(1),
(2) Date: Sep. 7, 2017

(87) PCT Pub. No.: WO2016/151462
PCT Pub. Date: Sep. 29, 2016

(65) Prior Publication Data

US 2018/0093470 A1 Apr. 5, 2018

(30) Foreign Application Priority Data

Mar. 20, 2015 (GB) ..... 1504716.0

(51) Int. Cl.
*B41J 29/38* (2006.01)
*B41J 2/01* (2006.01)

(52) U.S. Cl.
CPC ..... *B41J 2/01* (2013.01); *B41J 2002/012* (2013.01)

(58) Field of Classification Search
USPC ..... 347/102
See application file for complete search history.

(56) References Cited

U.S. PATENT DOCUMENTS 2,839,181 A 6/1958 Renner
3,697,551 A 10/1972 Thomson
(Continued)

FOREIGN PATENT DOCUMENTS

CN 1121033 A 4/1996
CN 1200085 A 11/1998
(Continued)

OTHER PUBLICATIONS

JP2009214439 Machine Translation (by PlatPat English machine translation)—published Sep. 24, 2009 Fujifilm Corp.
(Continued)

*Primary Examiner* — Lam S Nguyen
(74) *Attorney, Agent, or Firm* — Marc Van Dyke

(57) ABSTRACT

An indirect printing system is disclosed having an intermediate transfer member (ITM) in the form of an endless belt that circulates during operation to transport ink images from an image forming station. Ink images are deposited on an outer surface of the ITM by one or a plurality of print bars. At an impression station, the ink images are transferred from the outer surface of the ITM onto a printing substrate. In some embodiments, the outer surface of the ITM 20 is maintained within the image forming station at a predetermined distance from the one or each of the print bars 10, 12, 14 and 16 by means of a plurality of support rollers 11, 13, 15, 17 that have a common flat tangential plane and contact the inner surface of the ITM. In some embodiments, the inner surface of the ITM is attracted to the support rollers, the attraction being such that the area of contact between the ITM and each support roller is greater on the downstream side than the upstream side of the support roller, referenced to the direction of movement of the ITM.

20 Claims, 8 Drawing Sheets

(56) References Cited

U.S. PATENT DOCUMENTS 3,697,568 A 10/1972 Boissieras et al.
3,889,802 A 6/1975 Jonkers et al.
3,898,670 A 8/1975 Erikson et al.
3,947,113 A 3/1976 Buchan et al.
4,009,958 A 3/1977 Kurita et al.
4,093,764 A 6/1978 Duckett et al.
4,293,866 A 10/1981 Takita et al.
4,401,500 A 8/1983 Hamada et al.
4,535,694 A 8/1985 Fukuda
4,538,156 A 8/1985 Durkee et al.
4,642,654 A 2/1987 Toganoh et al.
4,853,737 A 8/1989 Hartley et al.
4,976,197 A 12/1990 Yamanari et al.
5,012,072 A 4/1991 Martin et al.
5,039,339 A 8/1991 Phan et al.
5,075,731 A 12/1991 Kamimura et al.
5,099,256 A 3/1992 Anderson
5,106,417 A 4/1992 Hauser et al.
5,128,091 A 7/1992 Agur et al.
5,190,582 A 3/1993 Shinozuka et al.
5,198,835 A 3/1993 Ando et al.
5,246,100 A 9/1993 Stone et al.
5,264,904 A 11/1993 Audi et al.
5,305,099 A 4/1994 Morcos
5,349,905 A 9/1994 Taylor et al.
5,352,507 A 10/1994 Bresson et al.
5,365,324 A 11/1994 Gu et al.
5,406,884 A 4/1995 Okuda et al.
5,471,233 A 11/1995 Okamoto et al.
5,532,314 A 7/1996 Sexsmith
5,552,875 A 9/1996 Sagiv et al.
5,587,779 A 12/1996 Heeren et al.
5,608,004 A 3/1997 Toyoda et al.
5,613,669 A 3/1997 Grueninger
5,614,933 A 3/1997 Hindman et al.
5,623,296 A 4/1997 Fujino et al.
5,642,141 A 6/1997 Hale et al.
5,660,108 A 8/1997 Pensavecchia
5,677,719 A 10/1997 Granzow
5,679,463 A 10/1997 Visser et al.
5,698,018 A 12/1997 Bishop et al.
5,723,242 A 3/1998 Woo et al.
5,733,698 A 3/1998 Lehman et al.
5,736,250 A 4/1998 Heeks et al.
5,772,746 A 6/1998 Sawada et al.
5,777,576 A 7/1998 Zur et al.
5,777,650 A 7/1998 Blank
5,841,456 A 11/1998 Takei et al.
5,859,076 A 1/1999 Kozma et al.
5,880,214 A 3/1999 Okuda
5,883,144 A 3/1999 Bambara et al.
5,883,145 A 3/1999 Hurley et al.
5,884,559 A 3/1999 Okubo et al.
5,889,534 A 3/1999 Johnson et al.
5,891,934 A 4/1999 Moffatt et al.
5,895,711 A 4/1999 Yamaki et al.
5,902,841 A 5/1999 Jaeger et al.
5,923,929 A 7/1999 Ben et al.
5,929,129 A 7/1999 Feichtinger
5,932,659 A 8/1999 Bambara et al.
5,935,751 A 8/1999 Matsuoka et al.
5,978,631 A 11/1999 Lee
5,978,638 A 11/1999 Tanaka et al.
5,991,590 A 11/1999 Chang et al.
6,004,647 A 12/1999 Bambara et al.
6,009,284 A 12/1999 Weinberger et al.
6,024,018 A 2/2000 Darel et al.
6,024,786 A 2/2000 Gore
6,033,049 A 3/2000 Fukuda
6,045,817 A 4/2000 Ananthapadmanabhan et al.
6,053,438 A 4/2000 Romano, Jr. et al.
6,055,396 A 4/2000 Pang
6,059,407 A 5/2000 Komatsu et al.
6,071,368 A 6/2000 Boyd et al.
6,072,976 A 6/2000 Kuriyama et al.
6,078,775 A 6/2000 Arai et al.
6,094,558 A 7/2000 Shimizu et al.
6,102,538 A 8/2000 Ochi et al.
6,103,775 A 8/2000 Bambara et al.
6,108,513 A 8/2000 Landa et al.
6,109,746 A 8/2000 Jeanmaire et al.
6,132,541 A 10/2000 Heaton
6,143,807 A 11/2000 Lin et al.
6,166,105 A 12/2000 Santilli et al.
6,195,112 B1 2/2001 Fassler et al.
6,196,674 B1 3/2001 Takemoto
6,213,580 B1 4/2001 Segerstrom et al.
6,214,894 B1 4/2001 Bambara et al.
6,221,928 B1 4/2001 Kozma et al.
6,234,625 B1 5/2001 Wen
6,242,503 B1 6/2001 Kozma et al.
6,257,716 B1 7/2001 Yanagawa et al.
6,261,688 B1 7/2001 Kaplan et al.
6,262,137 B1 7/2001 Kozma et al.
6,262,207 B1 7/2001 Rao et al.
6,303,215 B1 10/2001 Sonobe et al.
6,316,512 B1 11/2001 Bambara et al.
6,332,943 B1 12/2001 Herrmann et al.
6,354,700 B1 3/2002 Roth
6,357,869 B1 * 3/2002 Rasmussen ..... B41J 11/0025 271/196
6,357,870 B1 3/2002 Beach et al.
6,358,660 B1 3/2002 Agler et al.
6,363,234 B2 3/2002 Landa et al.
6,364,451 B1 4/2002 Silverbrook
6,383,278 B1 5/2002 Hirasa et al.
6,386,697 B1 5/2002 Yamamoto et al.
6,390,617 B1 5/2002 Iwao
6,397,034 B1 5/2002 Tarnawskyj et al.
6,400,913 B1 6/2002 de Jong et al.
6,402,317 B2 6/2002 Yanagawa et al.
6,409,331 B1 6/2002 Gelbart
6,432,501 B1 8/2002 Yang et al.
6,438,352 B1 8/2002 Landa et al.
6,454,378 B1 9/2002 Silverbrook et al.
6,471,803 B1 10/2002 Pelland et al.
6,530,321 B2 3/2003 Andrew et al.
6,530,657 B2 3/2003 Polierer
6,531,520 B1 3/2003 Bambara et al.
6,551,394 B2 4/2003 Hirasa et al.
6,551,716 B1 4/2003 Landa et al.
6,554,189 B1 4/2003 Good et al.
6,559,969 B1 5/2003 Lapstun
6,575,547 B2 6/2003 Sakuma
6,586,100 B1 7/2003 Pickering et al.
6,590,012 B2 7/2003 Miyabayashi
6,608,979 B1 8/2003 Landa et al.
6,623,817 B1 9/2003 Yang et al.
6,630,047 B2 10/2003 Jing et al.
6,639,527 B2 10/2003 Johnson
6,648,468 B2 11/2003 Shinkoda et al.
6,678,068 B1 1/2004 Richter et al.
6,682,189 B2 1/2004 May et al.
6,685,769 B1 2/2004 Karl et al.
6,704,535 B2 3/2004 Kobayashi et al.
6,709,096 B1 3/2004 Beach et al.
6,716,562 B2 4/2004 Uehara et al.
6,719,423 B2 4/2004 Chowdry et al.
6,720,367 B2 4/2004 Taniguchi et al.
6,755,519 B2 6/2004 Gelbart et al.
6,761,446 B2 7/2004 Chowdry et al.
6,770,331 B1 8/2004 Mielke et al.
6,789,887 B2 9/2004 Yang et al.
6,811,840 B1 11/2004 Cross
6,827,018 B1 12/2004 Hartmann et al.
6,881,458 B2 4/2005 Ludwig et al.
6,898,403 B2 5/2005 Baker et al.
6,912,952 B1 7/2005 Landa et al.
6,916,862 B2 7/2005 Ota et al.
6,917,437 B1 7/2005 Myers et al.
6,966,712 B2 11/2005 Trelewicz et al.
6,970,674 B2 11/2005 Sato et al.
6,974,022 B2 12/2005 Saeki
6,982,799 B2 1/2006 Lapstun

(56) References Cited

U.S. PATENT DOCUMENTS 6,983,692 B2 * 1/2006 Beauchamp ..... B41J 11/002 101/389.1
7,025,453 B2 4/2006 Ylitalo et al.
7,057,760 B2 6/2006 Lapstun et al.
7,084,202 B2 8/2006 Pickering et al.
7,128,412 B2 10/2006 King et al.
7,160,377 B2 1/2007 Zoch et al.
7,204,584 B2 4/2007 Lean et al.
7,213,900 B2 5/2007 Ebihara
7,224,478 B1 5/2007 Lapstun et al.
7,265,819 B2 9/2007 Raney
7,271,213 B2 9/2007 Hoshida et al.
7,296,882 B2 11/2007 Buehler et al.
7,300,133 B1 11/2007 Folkins et al.
7,300,147 B2 11/2007 Johnson
7,304,753 B1 12/2007 Richter et al.
7,322,689 B2 1/2008 Kohne et al.
7,334,520 B2 2/2008 Geissler et al.
7,348,368 B2 3/2008 Kakiuchi et al.
7,360,887 B2 4/2008 Konno
7,362,464 B2 4/2008 Kitazawa
7,459,491 B2 12/2008 Tyvoll et al.
7,527,359 B2 5/2009 Stevenson et al.
7,575,314 B2 8/2009 Desie et al.
7,612,125 B2 11/2009 Muller et al.
7,655,707 B2 2/2010 Ma
7,655,708 B2 2/2010 House et al.
7,699,922 B2 4/2010 Breton et al.
7,708,371 B2 5/2010 Yamanobe
7,709,074 B2 5/2010 Uchida et al.
7,712,890 B2 5/2010 Yahiro
7,732,543 B2 6/2010 Loch et al.
7,732,583 B2 6/2010 Annoura et al.
7,808,670 B2 10/2010 Lapstun et al.
7,810,922 B2 10/2010 Gervasi et al.
7,845,788 B2 12/2010 Oku
7,867,327 B2 1/2011 Sano et al.
7,910,183 B2 3/2011 Wu
7,919,544 B2 4/2011 Matsuyama et al.
7,942,516 B2 5/2011 Ohara et al.
7,977,408 B2 7/2011 Matsuyama et al.
7,985,784 B2 7/2011 Kanaya et al.
8,002,400 B2 8/2011 Kibayashi et al.
8,012,538 B2 9/2011 Yokouchi
8,025,389 B2 9/2011 Yamanobe et al.
8,038,284 B2 10/2011 Hori et al.
8,042,906 B2 10/2011 Chiwata et al.
8,059,309 B2 11/2011 Lapstun et al.
8,095,054 B2 1/2012 Nakamura
8,109,595 B2 2/2012 Tanaka et al.
8,122,846 B2 2/2012 Stiblert et al.
8,147,055 B2 4/2012 Cellura et al.
8,162,428 B2 4/2012 Eun et al.
8,177,351 B2 5/2012 Taniuchi et al.
8,186,820 B2 5/2012 Chiwata
8,192,904 B2 6/2012 Nagai et al.
8,215,762 B2 7/2012 Ageishi
8,242,201 B2 8/2012 Goto et al.
8,256,857 B2 9/2012 Folkins et al.
8,263,683 B2 9/2012 Gibson et al.
8,264,135 B2 9/2012 Ozolins et al.
8,295,733 B2 10/2012 Imoto
8,303,072 B2 11/2012 Shibata et al.
8,304,043 B2 11/2012 Nagashima et al.
8,353,589 B2 1/2013 Ikeda et al.
8,434,847 B2 5/2013 Dejong et al.
8,460,450 B2 6/2013 Taverizatshy et al.
8,469,476 B2 6/2013 Mandel et al.
8,474,963 B2 7/2013 Hasegawa et al.
8,536,268 B2 9/2013 Karjala et al.
8,546,466 B2 10/2013 Yamashita et al.
8,556,400 B2 10/2013 Yatake et al.
8,693,032 B2 4/2014 Goddard et al.
8,711,304 B2 4/2014 Mathew et al.
8,746,873 B2 6/2014 Tsukamoto et al.
8,779,027 B2 7/2014 Idemura et al.
8,802,221 B2 8/2014 Noguchi et al.
8,867,097 B2 10/2014 Mizuno
8,885,218 B2 11/2014 Hirose
8,891,128 B2 11/2014 Yamazaki
8,894,198 B2 11/2014 Hook et al.
8,919,946 B2 12/2014 Suzuki et al.
9,004,629 B2 4/2015 de Jong et al.
9,186,884 B2 11/2015 Landa et al.
9,229,664 B2 1/2016 Landa et al.
9,264,559 B2 2/2016 Motoyanagi et al.
9,284,469 B2 3/2016 Song et al.
9,327,496 B2 5/2016 Landa et al.
9,353,273 B2 5/2016 Landa et al.
9,381,736 B2 7/2016 Landa et al.
9,446,586 B2 9/2016 Matos et al.
9,498,946 B2 11/2016 Landa et al.
9,505,208 B2 11/2016 Shmaiser et al.
9,517,618 B2 12/2016 Landa et al.
9,566,780 B2 2/2017 Landa et al.
9,643,400 B2 5/2017 Landa et al.
9,643,403 B2 5/2017 Landa et al.
9,776,391 B2 10/2017 Landa et al.
9,782,993 B2 10/2017 Landa et al.
9,849,667 B2 12/2017 Landa et al.
9,884,479 B2 2/2018 Landa et al.
9,902,147 B2 2/2018 Shmaiser et al.
9,914,316 B2 3/2018 Landa et al.
10,065,411 B2 9/2018 Landa et al.
10,175,613 B2 1/2019 Watanabe
10,179,447 B2 1/2019 Shmaiser et al.
10,190,012 B2 1/2019 Landa et al.
10,195,843 B2 2/2019 Landa et al.
10,201,968 B2 2/2019 Landa et al.
10,226,920 B2 3/2019 Shmaiser et al.
10,266,711 B2 4/2019 Landa et al.
10,300,690 B2 5/2019 Landa et al.
2001/0022607 A1 9/2001 Takahashi et al.
2002/0041317 A1 4/2002 Kashiwazaki et al.
2002/0064404 A1 5/2002 Iwai
2002/0102374 A1 8/2002 Gervasi et al.
2002/0121220 A1 9/2002 Lin
2002/0150408 A1 10/2002 Mosher et al.
2002/0164494 A1 11/2002 Grant et al.
2002/0197481 A1 12/2002 Jing et al.
2003/0004025 A1 1/2003 Okuno et al.
2003/0018119 A1 1/2003 Frenkel et al.
2003/0030686 A1 2/2003 Abe et al.
2003/0032700 A1 2/2003 Morrison et al.
2003/0043258 A1 * 3/2003 Kerr ..... B41J 13/223 347/262
2003/0054139 A1 3/2003 Ylitalo et al.
2003/0055129 A1 3/2003 Alford
2003/0063179 A1 4/2003 Adachi
2003/0081964 A1 5/2003 Shimura et al.
2003/0118381 A1 6/2003 Law
2003/0129435 A1 7/2003 Blankenship et al.
2003/0186147 A1 10/2003 Pickering et al.
2003/0214568 A1 11/2003 Nishikawa et al.
2003/0234849 A1 12/2003 Pan et al.
2004/0003863 A1 1/2004 Eckhardt
2004/0020382 A1 2/2004 McLean et al.
2004/0047666 A1 3/2004 Imaizumi et al.
2004/0087707 A1 5/2004 Zoch et al.
2004/0123761 A1 7/2004 Szumla et al.
2004/0125188 A1 7/2004 Szumla et al.
2004/0173111 A1 9/2004 Okuda
2004/0200369 A1 10/2004 Brady
2004/0228642 A1 11/2004 Iida et al.
2004/0246324 A1 12/2004 Nakashima
2004/0246326 A1 12/2004 Dwyer et al.
2005/0031807 A1 2/2005 Quintens et al.
2005/0082146 A1 4/2005 Axmann
2005/0110855 A1 5/2005 Taniuchi et al.
2005/0134874 A1 6/2005 Overall et al.
2005/0150408 A1 7/2005 Hesterman
2005/0195235 A1 9/2005 Kitao
2005/0235870 A1 10/2005 Ishihara
2005/0266332 A1 12/2005 Pavlisko et al.

(56) References Cited

U.S. PATENT DOCUMENTS

2005/0272334 A1 12/2005 Wang et al.
2006/0004123 A1 1/2006 Wu et al.
2006/0135709 A1 6/2006 Hasegawa et al.
2006/0164488 A1 7/2006 Taniuchi et al.
2006/0164489 A1 7/2006 Vega et al.
2006/0192827 A1 8/2006 Takada et al.
2006/0233578 A1 10/2006 Maki et al.
2006/0286462 A1 12/2006 Jackson et al.
2007/0014595 A1 1/2007 Kawagoe
2007/0025768 A1 2/2007 Komatsu et al.
2007/0029171 A1 2/2007 Nemedi
2007/0054981 A1 3/2007 Yanagi et al.
2007/0120927 A1 5/2007 Snyder et al.
2007/0123642 A1 5/2007 Banning et al.
2007/0134030 A1 6/2007 Lior et al.
2007/0144368 A1 6/2007 Barazani et al.
2007/0146462 A1 6/2007 Taniuchi et al.
2007/0147894 A1 6/2007 Yokota et al.
2007/0166071 A1 7/2007 Shima
2007/0176995 A1 8/2007 Kadomatsu et al.
2007/0189819 A1 8/2007 Uehara et al.
2007/0199457 A1 8/2007 Cyman et al.
2007/0229639 A1 10/2007 Yahiro
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0044587 A1 2/2008 Maeno et al.
2008/0055356 A1 3/2008 Yamanobe
2008/0055381 A1 3/2008 Doi et al.
2008/0055385 A1 3/2008 Houjou
2008/0074462 A1 3/2008 Hirakawa
2008/0112912 A1 5/2008 Springob et al.
2008/0138546 A1 6/2008 Soria et al.
2008/0166495 A1 7/2008 Maeno et al.
2008/0167185 A1 7/2008 Hirota
2008/0175612 A1 7/2008 Oikawa et al.
2008/0196612 A1 8/2008 Rancourt et al.
2008/0196621 A1 8/2008 Ikuno et al.
2008/0213548 A1 9/2008 Koganehira et al.
2008/0236480 A1 10/2008 Furukawa et al.
2008/0253812 A1 10/2008 Pearce et al.
2009/0022504 A1 1/2009 Kuwabara et al.
2009/0041932 A1 2/2009 Ishizuka et al.
2009/0074492 A1 3/2009 Ito
2009/0082503 A1 3/2009 Yanagi et al.
2009/0087565 A1 4/2009 Houjou
2009/0098385 A1 4/2009 Kaemper et al.
2009/0116885 A1 5/2009 Ando
2009/0148200 A1 6/2009 Hara et al.
2009/0165937 A1 7/2009 Inoue et al.
2009/0190951 A1 7/2009 Torimaru et al.
2009/0202275 A1 8/2009 Nishida et al.
2009/0211490 A1 8/2009 Ikuno et al.
2009/0220873 A1 9/2009 Enomoto et al.
2009/0237479 A1 9/2009 Yamashita et al.
2009/0256896 A1 10/2009 Scarlata
2009/0279170 A1 11/2009 Miyazaki et al.
2009/0315926 A1 12/2009 Yamanobe
2009/0317555 A1 12/2009 Hori
2009/0318591 A1 12/2009 Ageishi et al.
2010/0012023 A1 1/2010 Lefevre et al.
2010/0053292 A1 3/2010 Thayer et al.
2010/0053293 A1 3/2010 Thayer et al.
2010/0066796 A1 3/2010 Yanagi et al.
2010/0075843 A1 3/2010 Ikuno et al.
2010/0086692 A1 4/2010 Ohta et al.
2010/0091064 A1 4/2010 Araki et al.
2010/0111577 A1 5/2010 Soria et al.
2010/0231623 A1 9/2010 Hirato
2010/0239789 A1 9/2010 Umeda
2010/0282100 A1 11/2010 Okuda et al.
2010/0285221 A1 11/2010 Oki et al.
2010/0303504 A1 12/2010 Funamoto et al.
2010/0310281 A1 12/2010 Miura et al.
2011/0044724 A1 2/2011 Funamoto et al.
2011/0058001 A1 3/2011 Gila et al.
2011/0085828 A1 4/2011 Kosako et al.
2011/0128300 A1 6/2011 Gay et al.
2011/0141188 A1 6/2011 Morita
2011/0150509 A1 6/2011 Komiya
2011/0150541 A1 6/2011 Michibata
2011/0169889 A1 7/2011 Kojima et al.
2011/0195260 A1 8/2011 Lee et al.
2011/0199414 A1 8/2011 Lang
2011/0234683 A1 9/2011 Komatsu
2011/0234689 A1 9/2011 Saito
2011/0249090 A1 10/2011 Moore et al.
2011/0269885 A1 11/2011 Imai
2011/0279554 A1 11/2011 Dannhauser et al.
2011/0304674 A1 12/2011 Sambhy et al.
2012/0013693 A1 1/2012 Tasaka et al.
2012/0013694 A1 1/2012 Kanke
2012/0013928 A1 1/2012 Yoshida et al.
2012/0026224 A1 2/2012 Anthony et al.
2012/0039647 A1 2/2012 Brewington et al.
2012/0094091 A1 4/2012 Van Mil et al.
2012/0098882 A1 4/2012 Onishi et al.
2012/0105525 A1 5/2012 Leung et al.
2012/0105561 A1 5/2012 Taniuchi et al.
2012/0105562 A1 5/2012 Sekiguchi et al.
2012/0113180 A1 5/2012 Tanaka et al.
2012/0113203 A1 5/2012 Kushida et al.
2012/0127250 A1 5/2012 Kanasugi et al.
2012/0127251 A1 5/2012 Tsuji et al.
2012/0140009 A1 6/2012 Kanasugi et al.
2012/0156375 A1 6/2012 Brust et al.
2012/0156624 A1 6/2012 Rondon et al.
2012/0162302 A1 6/2012 Oguchi et al.
2012/0163846 A1 6/2012 Andoh et al.
2012/0194830 A1 8/2012 Gaertner et al.
2012/0237260 A1 9/2012 Sengoku et al.
2012/0287260 A1 11/2012 Lu et al.
2012/0301186 A1 11/2012 Yang et al.
2012/0314077 A1 12/2012 Clavenna, II et al.
2013/0044188 A1 2/2013 Nakamura et al.
2013/0057603 A1 3/2013 Gordon
2013/0088543 A1 4/2013 Tsuji et al.
2013/0120513 A1 5/2013 Thayer et al.
2013/0201237 A1 8/2013 Thomson et al.
2013/0242016 A1 9/2013 Edwards et al.
2013/0338273 A1 12/2013 Shimanaka et al.
2014/0001013 A1 1/2014 Takifuji et al.
2014/0011125 A1 1/2014 Inoue et al.
2014/0043398 A1 2/2014 Butler et al.
2014/0104360 A1 4/2014 Häcker et al.
2014/0168330 A1 6/2014 Liu et al.
2014/0232782 A1 8/2014 Mukai et al.
2014/0267777 A1 9/2014 Le Clerc et al.
2014/0339056 A1 11/2014 Iwakoshi et al.
2015/0022602 A1* 1/2015 Landa ..... G03G 15/0189 347/102
2015/0024648 A1 1/2015 Landa et al.
2015/0025179 A1 1/2015 Landa et al.
2015/0049134 A1 2/2015 Shmaiser et al.
2015/0072090 A1 3/2015 Landa et al.
2015/0085036 A1 3/2015 Liu et al.
2015/0085037 A1 3/2015 Liu et al.
2015/0116408 A1 4/2015 Armbruster et al.
2015/0118503 A1 4/2015 Landa et al.
2015/0195509 A1 7/2015 Phipps
2015/0210065 A1 7/2015 Kelly et al.
2015/0304531 A1 10/2015 Rodriguez Garcia et al.
2015/0336378 A1 11/2015 Guttmann et al.
2016/0222232 A1 8/2016 Landa et al.
2016/0286462 A1 9/2016 Gohite et al.
2017/0028688 A1 2/2017 Dannhauser et al.
2017/0104887 A1 4/2017 Nomura
2017/0192374 A1 7/2017 Landa et al.
2017/0244956 A1 8/2017 Stiglic et al.
2018/0065358 A1 3/2018 Landa et al.
2018/0079201 A1 3/2018 Landa et al.
2018/0222235 A1 8/2018 Landa et al.
2018/0259888 A1 9/2018 Mitsui et al.

(56) References Cited

U.S. PATENT DOCUMENTS

| | | | |
|---|---|---|---|
| 2019/0023919 | A1 | 1/2019 | Landa et al. |
| 2019/0084295 | A1 | 3/2019 | Shmaiser et al. |
| 2019/0118530 | A1 | 4/2019 | Landa et al. |
| 2019/0152218 | A1 | 5/2019 | Stein et al. |
| 2019/0168502 | A1 | 6/2019 | Shmaiser et al. |
| 2019/0193391 | A1 | 6/2019 | Landa et al. |
| 2019/0202198 | A1 | 7/2019 | Shmaiser et al. |
| 2019/0358982 | A1 | 11/2019 | Landa et al. |
| 2019/0366705 | A1 | 12/2019 | Landa et al. |

FOREIGN PATENT DOCUMENTS

| | | | |
|---|---|---|---|
| CN | 1212229 | A | 3/1999 |
| CN | 1324901 | A | 12/2001 |
| CN | 1493514 | A | 5/2004 |
| CN | 1720187 | A | 1/2006 |
| CN | 1809460 | A | 7/2006 |
| CN | 101073937 | A | 11/2007 |
| CN | 101177057 | A | 5/2008 |
| CN | 101344746 | A | 1/2009 |
| CN | 101544101 | A | 9/2009 |
| CN | 101607468 | A | 12/2009 |
| CN | 201410787 | Y | 2/2010 |
| CN | 101873982 | A | 10/2010 |
| CN | 102555450 | A | 7/2012 |
| CN | 102648095 | A | 8/2012 |
| CN | 102925002 | A | 2/2013 |
| CN | 103991293 | A | 8/2014 |
| CN | 104618642 | A | 5/2015 |
| DE | 102010060999 | A1 | 6/2012 |
| EP | 0457551 | A2 | 11/1991 |
| EP | 0499857 | A1 | 8/1992 |
| EP | 0606490 | A1 | 7/1994 |
| EP | 0609076 | A2 | 8/1994 |
| EP | 0613791 | A2 | 9/1994 |
| EP | 0530627 | B1 | 3/1997 |
| EP | 0784244 | A2 | 7/1997 |
| EP | 0843236 | A2 | 5/1998 |
| EP | 0854398 | A2 | 7/1998 |
| EP | 1013466 | A2 | 6/2000 |
| EP | 1146090 | A2 | 10/2001 |
| EP | 1158029 | A1 | 11/2001 |
| EP | 0825029 | B1 | 5/2002 |
| EP | 1247821 | A2 | 10/2002 |
| EP | 0867483 | B1 | 6/2003 |
| EP | 1454968 | A1 | 9/2004 |
| EP | 1503326 | A1 | 2/2005 |
| EP | 2028238 | A1 | 2/2009 |
| EP | 2042317 | A1 | 4/2009 |
| EP | 2065194 | A2 | 6/2009 |
| EP | 2228210 | A1 | 9/2010 |
| EP | 2270070 | A1 | 1/2011 |
| EP | 2042318 | B1 | 2/2011 |
| EP | 2042325 | B1 | 2/2012 |
| EP | 2683556 | A1 | 1/2014 |
| EP | 2075635 | B1 | 10/2014 |
| GB | 748821 | A | 5/1956 |
| GB | 1496016 | A | 12/1977 |
| GB | 1520932 | A | 8/1978 |
| GB | 1522175 | A | 8/1978 |
| GB | 2321430 | A | 7/1998 |
| JP | S5578904 | A | 6/1980 |
| JP | S567968 | A | 1/1981 |
| JP | S6076343 | A | 4/1985 |
| JP | S60199692 | A | 10/1985 |
| JP | H03248170 | A | 11/1991 |
| JP | H05147208 | A | 6/1993 |
| JP | H05297737 | A | 11/1993 |
| JP | H06100807 | A | 4/1994 |
| JP | H06171076 | A | 6/1994 |
| JP | H06345284 | A | 12/1994 |
| JP | H07112841 | A | 5/1995 |
| JP | H07186453 | A | 7/1995 |
| JP | H07238243 | A | 9/1995 |
| JP | H0862999 | A | 3/1996 |
| JP | H08112970 | A | 5/1996 |
| JP | 2529651 | B2 | 8/1996 |
| JP | H09123432 | A | 5/1997 |
| JP | H09281851 | A | 10/1997 |
| JP | H09314867 | A | 12/1997 |
| JP | H11503244 | A | 3/1999 |
| JP | H11106081 | A | 4/1999 |
| JP | 2000108320 | A | 4/2000 |
| JP | 2000108334 | A | 4/2000 |
| JP | 2000169772 | A | 6/2000 |
| JP | 2000206801 | A | 7/2000 |
| JP | 2001206522 | A | 7/2001 |
| JP | 2002020666 | A | 1/2002 |
| JP | 2002103598 | A | 4/2002 |
| JP | 2002169383 | A | 6/2002 |
| JP | 2002229276 | A | 8/2002 |
| JP | 2002234243 | A | 8/2002 |
| JP | 2002278365 | A | 9/2002 |
| JP | 2002304066 | A | 10/2002 |
| JP | 2002326733 | A | 11/2002 |
| JP | 2002371208 | A | 12/2002 |
| JP | 2003057967 | A | 2/2003 |
| JP | 2003114558 | A | 4/2003 |
| JP | 2003183557 | A | 7/2003 |
| JP | 2003211770 | A | 7/2003 |
| JP | 2003219271 | A | 7/2003 |
| JP | 2003246135 | A | 9/2003 |
| JP | 2003246484 | A | 9/2003 |
| JP | 2003292855 | A | 10/2003 |
| JP | 2004009632 | A | 1/2004 |
| JP | 2004019022 | A | 1/2004 |
| JP | 2004025708 | A | 1/2004 |
| JP | 2004034441 | A | 2/2004 |
| JP | 2004077669 | A | 3/2004 |
| JP | 2004114377 | A | 4/2004 |
| JP | 2004114675 | A | 4/2004 |
| JP | 2004148687 | A | 5/2004 |
| JP | 2004231711 | A | 8/2004 |
| JP | 2004524190 | A | 8/2004 |
| JP | 2004261975 | A | 9/2004 |
| JP | 2004325782 | A | 11/2004 |
| JP | 2005014255 | A | 1/2005 |
| JP | 2005014256 | A | 1/2005 |
| JP | 2005114769 | A | 4/2005 |
| JP | 2005215247 | A | 8/2005 |
| JP | 2005307184 | A | 11/2005 |
| JP | 2005319593 | A | 11/2005 |
| JP | 2006001688 | A | 1/2006 |
| JP | 2006095870 | A | 4/2006 |
| JP | 2006102975 | A | 4/2006 |
| JP | 2006137127 | A | 6/2006 |
| JP | 2006143778 | A | 6/2006 |
| JP | 2006152133 | A | 6/2006 |
| JP | 2006224583 | A | 8/2006 |
| JP | 2006231666 | A | 9/2006 |
| JP | 2006243212 | A | 9/2006 |
| JP | 2006263984 | A | 10/2006 |
| JP | 2006347081 | A | 12/2006 |
| JP | 2006347085 | A | 12/2006 |
| JP | 2007041530 | A | 2/2007 |
| JP | 2007069584 | A | 3/2007 |
| JP | 2007190745 | A | 8/2007 |
| JP | 2007216673 | A | 8/2007 |
| JP | 2007253347 | A | 10/2007 |
| JP | 2007334125 | A | 12/2007 |
| JP | 2008006816 | A | 1/2008 |
| JP | 2008018716 | A | 1/2008 |
| JP | 2008039698 | A | 2/2008 |
| JP | 2008137239 | A | 6/2008 |
| JP | 2008139877 | A | 6/2008 |
| JP | 2008142962 | A | 6/2008 |
| JP | 2008194997 | A | 8/2008 |
| JP | 2008532794 | A | 8/2008 |
| JP | 2008201564 | A | 9/2008 |
| JP | 2008238674 | A | 10/2008 |
| JP | 2008246990 | A | 10/2008 |
| JP | 2008255135 | A | 10/2008 |
| JP | 2009040892 | A | 2/2009 |
| JP | 2009045794 | A | 3/2009 |

(56) References Cited

FOREIGN PATENT DOCUMENTS

| | | | |
|---|---|---|---|
| JP | 2009045851 | A | 3/2009 |
| JP | 2009045885 | A | 3/2009 |
| JP | 2009083314 | A | 4/2009 |
| JP | 2009083317 | A | 4/2009 |
| JP | 2009083325 | A | 4/2009 |
| JP | 2009096175 | A | 5/2009 |
| JP | 2009148908 | A | 7/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009214439 | A | 9/2009 |
| JP | 2009226852 | A | 10/2009 |
| JP | 2009226886 | A | 10/2009 |
| JP | 2009233977 | A | 10/2009 |
| JP | 2009234219 | A | 10/2009 |
| JP | 2010005815 | A | 1/2010 |
| JP | 2010054855 | A | 3/2010 |
| JP | 2010510357 | A | 4/2010 |
| JP | 2010105365 | A | 5/2010 |
| JP | 2010173201 | A | 8/2010 |
| JP | 2010184376 | A | 8/2010 |
| JP | 2010214885 | A | 9/2010 |
| JP | 2010228192 | A | 10/2010 |
| JP | 2010234599 | A | 10/2010 |
| JP | 2010234681 | A | 10/2010 |
| JP | 2010241073 | A | 10/2010 |
| JP | 2010247381 | A | 11/2010 |
| JP | 2010247528 | A | 11/2010 |
| JP | 2010258193 | A | 11/2010 |
| JP | 2010260204 | A | 11/2010 |
| JP | 2010260287 | A | 11/2010 |
| JP | 2010260302 | A | 11/2010 |
| JP | 2010286570 | A | 12/2010 |
| JP | 2011002532 | A | 1/2011 |
| JP | 2011025431 | A | 2/2011 |
| JP | 2011037070 | A | 2/2011 |
| JP | 2011126031 | A | 6/2011 |
| JP | 2011133884 | A | 7/2011 |
| JP | 2011144271 | A | 7/2011 |
| JP | 2011173325 | A | 9/2011 |
| JP | 2011173326 | A | 9/2011 |
| JP | 2011186346 | A | 9/2011 |
| JP | 2011189627 | A | 9/2011 |
| JP | 2011201951 | A | 10/2011 |
| JP | 2011224032 | A | 11/2011 |
| JP | 2012086499 | A | 5/2012 |
| JP | 2012111194 | A | 6/2012 |
| JP | 2012126123 | A | 7/2012 |
| JP | 2012139905 | A | 7/2012 |
| JP | 2012196787 | A | 10/2012 |
| JP | 2013001081 | A | 1/2013 |
| JP | 2013060299 | A | 4/2013 |
| JP | 2013103474 | A | 5/2013 |
| JP | 2013121671 | A | 6/2013 |
| JP | 2013129158 | A | 7/2013 |
| JP | 2014094827 | A | 5/2014 |
| JP | 2016185688 | A | 10/2016 |
| RU | 2180675 | C2 | 3/2002 |
| RU | 2282643 | C1 | 8/2006 |
| WO | WO8600327 | A1 | 1/1986 |
| WO | 9307000 | A1 | 4/1993 |
| WO | WO9604339 | A1 | 2/1996 |
| WO | WO9631809 | A1 | 10/1996 |
| WO | WO9707991 | A1 | 3/1997 |
| WO | WO9736210 | A1 | 10/1997 |
| WO | WO9821251 | A1 | 5/1998 |
| WO | WO9855901 | A1 | 12/1998 |
| WO | WO9912633 | A1 | 3/1999 |
| WO | WO9942509 | A1 | 8/1999 |
| WO | WO 99/43502 | A1 | 9/1999 |
| WO | WO0064685 | A1 | 11/2000 |
| WO | WO0154902 | A1 | 8/2001 |
| WO | WO0170512 | A1 | 9/2001 |
| WO | WO02068191 | A1 | 9/2002 |
| WO | WO02078868 | A2 | 10/2002 |
| WO | WO02094912 | A1 | 11/2002 |
| WO | WO2004113082 | A1 | 12/2004 |
| WO | WO2004113450 | A1 | 12/2004 |
| WO | WO2006051733 | A1 | 5/2006 |
| WO | WO2006069205 | A1 | 6/2006 |
| WO | WO2006073696 | A1 | 7/2006 |
| WO | WO2006091957 | A2 | 8/2006 |
| WO | WO2007009871 | A2 | 1/2007 |
| WO | WO2007145378 | A1 | 12/2007 |
| WO | WO2008078841 | A1 | 7/2008 |
| WO | WO2009025809 | A1 | 2/2009 |
| WO | WO2009134273 | A1 | 11/2009 |
| WO | WO2010042784 | A3 | 7/2010 |
| WO | WO-2010073916 | A1 | 7/2010 |
| WO | WO2011142404 | A1 | 11/2011 |
| WO | WO2012014825 | A1 | 2/2012 |
| WO | WO2012148421 | A1 | 11/2012 |
| WO | WO2013060377 | A1 | 5/2013 |
| WO | 2013087249 | A1 | 6/2013 |
| WO | 2013136220 | A1 | 9/2013 |
| WO | WO2013132339 | A1 | 9/2013 |
| WO | WO2013132340 | A1 | 9/2013 |
| WO | WO2013132343 | A1 | 9/2013 |
| WO | WO2013132345 | A1 | 9/2013 |
| WO | WO2013132356 | A1 | 9/2013 |
| WO | WO 2013132418 | A1 | 9/2013 |
| WO | WO2013132419 | A1 | 9/2013 |
| WO | WO 2013132420 | A1 | 9/2013 |
| WO | WO2013132424 | A1 | 9/2013 |
| WO | WO 2013132432 | A1 | 9/2013 |
| WO | WO2013132438 | A2 | 9/2013 |
| WO | WO2013132439 | A1 | 9/2013 |
| WO | WO2015036864 | A1 | 3/2015 |
| WO | WO2015036906 | A1 | 3/2015 |
| WO | WO2015036960 | A1 | 3/2015 |
| WO | WO2016166690 | A1 | 10/2016 |

OTHER PUBLICATIONS

JPH09314867A Machine Translation (by PlatPat English machine translation)—published Dec. 9, 1997, Toshiba Corp.

JPH06171076A Machine Translation (by PlatPat English machine translation)—published Jun. 21, 1994, Seiko Epson Corp.

CN104618642 Machine Translation (by EPO and Google); published on May 13, 2015, Yulong Comp Comm Tech Shenzhen.

Co-pending U.S. Appl. No. 16/047,033, filed Jul. 27, 2018.

DE102010060999 Machine Translation (by EPO and Google)—published Jun. 6, 2012; Wolf, Roland, Dr.-Ing.

JP2000108320 Machine Translation (by PlatPat English machine translation)—published Apr. 18, 2000 Brother Ind. Ltd.

JP2002-169383 Machine Translation (by EPO, PlatPat and Google)—published Jun. 14, 2002 Richo KK.

JP2002-326733 Machine Translation (by EPO, PlatPat and Google)—published Nov. 12, 2002; Kyocera Mita Corp.

JP2003-114558 Machine Translation (by EPO, PlatPat and Google)—published Apr. 18, 2003 Mitsubishi Chem Corp, Yuka Denshi Co Ltd, et al.

JP2003-211770 Machine Translation (by EPO and Google)—published Jul. 29, 2003 Hitachi Printing Solutions.

JP2003219271 Machine Translation (by EPO and Google); published on Jul. 31, 2003, Japan Broadcasting.

JP2004077669 Machine Translation (by PlatPat English machine translation)—published Mar. 11, 2004 Fuji Xerox Co Ltd.

JP2004114377(A) Machine Translation (by EPO and Google)—published Apr. 15, 2004; Konica Minolta Holdings Inc, et al.

JP2004114675 Machine Translation (by EPO and Google)—published Apr. 15, 2004; Canon Inc.

JP2005014255 Machine Translation (by EPO and Google)—published Jan. 20, 2005; Canon Inc.

JP2005114769 Machine Translation (by PlatPat English machine translation)—published Apr. 28, 2005 Ricoh KK.

JP2006001688 Machine Translation (by PlatPat English machine translation)—published Jan. 5, 2006 Ricoh KK.

(56) References Cited

OTHER PUBLICATIONS

JP2006-102975 Machine Translation (by EPO and Google)—published Apr. 20, 2006; Fuji Photo Film Co Ltd.
JP2006-137127 Machine Translation (by EPO and Google)—published Jun. 1, 2006; Konica Minolta Med & Graphic.
JP2006243212 Machine Translation (by PlatPat English machine translation)—published Sep. 14, 2006 Fuji Xerox Co Ltd.
JP2006-347081 Machine Translation (by EPO and Google)—published Dec. 28, 2006; Fuji Xerox Co Ltd.
JP2007-069584 Machine Translation (by EPO and Google)—published Mar. 22, 2007 Fujifilm.
JP2007-216673 Machine Translation (by EPO and Google)—published Aug. 30, 2007 Brother Ind.
JP2008039698 Machine Translation (by EPO and Google)—published Feb. 21, 2008, Univ Nagoya.
JP2008-142962 Machine Translation (by EPO and Google)—published Jun. 26, 2008; Fuji Xerox Co Ltd.
JP2008-255135 Machine Translation (by EPO and Google)—published Oct. 23, 2008; Fujifilm Corp.
JP2009-045794 Machine Translation (by EPO and Google)—published Mar. 5, 2009; Fujifilm Corp.
JP2009-083317 Abstract; Machine Translation (by EPO and Google)—published Apr. 23, 2009; Fuji Film Corp.
JP2009-083325 Abstract; Machine Translation (by EPO and Google)—published Apr. 23, 2009 Fujifilm.
JP2009-154330 Machine Translation (by EPO and Google)—published Jul. 16, 2009; Seiko Epson Corp.
JP2009-190375 Machine Translation (by EPO and Google)—published Aug. 27, 2009; Fuji Xerox Co Ltd.
JP2009-202355 Machine Translation (by EPO and Google)—published Sep. 10, 2009; Fuji Xerox Co Ltd.
JP2009-214318 Machine Translation (by EPO and Google)—published Sep. 24, 2009 Fuji Xerox Co Ltd.
JP2009-226852 Machine Translation (by EPO and Google)—published Oct. 8, 2009; Hirato Katsuyuki, Fujifilm Corp.
JP2009-233977 Machine Translation (by EPO and Google)—published Oct. 15, 2009; Fuji Xerox Co Ltd.
JP2009-234219 Machine Translation (by EPO and Google)—published Oct. 15, 2009; Fujifilm Corp.
JP2010-054855 Machine Translation (by PlatPat English machine translation)—published Mar. 11, 2010 Itatsu, Fuji Xerox Co.
JP2010-105365 Machine Translation (by EPO and Google)—published May 13, 2010; Fuji Xerox Co Ltd.
JP2010-173201 Abstract; Machine Translation (by EPO and Google)—published Aug. 12, 2010; Richo Co Ltd.
JP2010-241073 Machine Translation (by EPO and Google)—published Oct. 28, 2010; Canon Inc.
JP2011002532 Machine Translation (by PlatPat English machine translation)—published Jun. 1, 2011 Seiko Epson Corp.
JP2011-025431 Machine Translation (by EPO and Google)—published Feb. 10, 2011; Fuji Xerox Co Ltd.
JP2011-173325 Abstract; Machine Translation (by EPO and Google)—published Sep. 8, 2011; Canon Inc.
JP2011-173326 Machine Translation (by EPO and Google)—published Sep. 8, 2011; Canon Inc.
JP2012-086499 Machine Translation (by EPO and Google)—published May 10, 2012; Canon Inc.
JP2012-111194 Machine Translation (by EPO and Google)—published Jun. 14, 2012; Konica Minolta.
JPH5-297737 Machine Translation (by EPO & Google machine translation)—published Nov. 12, 1993 Fuji Xerox Co Ltd.
Marconi Studios, Virtual Set Real Time; http://www.marconistudios.il/pages/virtualset_en.php.
Royal Television Society, The Flight of the Phoenix; https://rts.org.uk/article/flight-phoenix, Jan. 27, 2011.
WO2013/087249 Machine Translation (by EPO and Google)—published Jun. 20, 2013; Koenig & Bauer AG.
"Amino Functional Silicone Polymers", in Xiameter.COPYRGT. 2009 Dow Corning Corporation.
BASF , "JONCRYL 537", Datasheet , Retrieved from the internet : Mar. 23, 2007 p. 1.
Clariant., "Ultrafine Pigment Dispersion for Design and Creative Materials: Hostafine Pigment Preparation" Jun. 19, 2008. Retrieved from the Internet: [URL: http://www.clariant.com/C125720D002B963C/4352D0BC052E90CEC1257479002707D9/$FILE/DP6208E_0608_FL_Hostafinefordesignandcreativematerials.pdf].
CN101177057 Machine Translation (by EPO and Google) published May 14, 2008 Hangzhou Yuanyang Industry Co.
CN101873982A Machine Translation (by EPO and Google) published Oct. 27, 2010; HABASIT AG, Delair et al.
CN102555450A Machine Translation (by EPO and Google) published Jul. 11, 2012; Fuji Xerox Co., Ltd, Motoharu et al.
CN102925002 Machine Translation (by EPO and Google) published Feb. 13, 2013; Jiangnan University, Fu et al.
CN103991293A Machine Translation (by EPO and Google) published Aug. 20, 2014; Miyakoshi Printing Machinery Co., Ltd, Junichi et al.
CN1493514A Machine Translation (by EPO and Google) published May 5, 2004; GD SPA, Boderi et al.
Copending U.S. Appl. No. 16/231,693, filed Dec. 24, 2018.
Copending U.S. Appl. No. 16/282,317, filed Feb. 22, 2019.
Copending U.S. Appl. No. 16/303,613, filed Nov. 20, 2018.
Copending U.S. App. No. 16/303,615, filed Nov. 20, 2018.
Copending U.S. Appl. No. 16/303,631, filed Nov. 20, 2018.
Epomin Polyment, product information from Nippon Shokubai, dated Feb. 28, 2014.
Handbook of Print Media, 2001, Springer Verlag, Berlin/Heidelberg/New York, pp. 127136,748 With English Translation.
IP.com Search, 2018, 2 pages.
JP2000169772 Machine Translation (by EPO and Google) published Jun. 20, 2000; Tokyo Ink MFG Co Ltd.
JP2000206801 Machine Translation (by PlatPat English machine translation); published on Jul. 28, 2000, Canon KK, Kobayashi et al.
JP2001206522 Machine Translation (by EPO, PlatPat and Google) published Jul. 31, 2001; Nitto Denko Corp, Kato et al.
JP2002234243 Machine Translation (by EPO and Google) published Aug. 20, 2002; Hitachi Koki Co Ltd.
JP2002278365 Machine Translation (by PlatPat English machine translation) published Sep. 27, 2002 Katsuaki, Ricoh KK.
JP2002304066A Machine Translation (by EPO and Google) published Oct. 18, 2002; PFU Ltd.
JP2002371208 Machine Translation (by EPO and Google) published Dec. 26, 2002; Canon Inc.
JP2003246135 Machine Translation (by PlatPat English machine translation) published Sep. 2, 2003 Ricoh KK, Morohoshi et al.
JP2003246484 Machine Translation (English machine translation) published Sep. 2, 2003 Kyocera Corp.
JP2003292855A Machine Translation (by EPO and Google) published Oct. 15, 2003; Konishiroku Photo Ind.
JP2004009632A Machine Translation (by EPO and Google) published Jan. 15, 2004; Konica Minolta Holdings Inc.
JP2004019022 Machine Translation (by EPO and Google) published Jan. 22, 2004; Yamano et al.
JP2004025708A Machine Translation (by EPO and Google) published Jan. 29, 2004; Konica Minolta Holdings Inc.
JP2004034441A Machine Translation (by EPO and Google) published Feb. 5, 2004; Konica Minolta Holdings Inc.
JP2004148687A Machine Translation (by EPO and Google) published May 27, 2014; Mitsubishi Heavy Ind Ltd.
JP2004231711 Machine Translation (by EPO and Google) published Aug. 19, 2004; Seiko Epson Corp.
JP2004261975 Machine Translation (by EPO, PlatPat and Google); published on Sep. 24, 2004, Seiko Epson Corp, Kataoka et al.
JP2004325782A Machine Translation (by EPO and Google) published Nov. 18, 2004; Canon KK.
JP2005014256 Machine Translation (by EPO and Google) published Jan. 20, 2005; Canon Inc.
JP2005215247A Machine Translation (by EPO and Google) published Aug. 11, 2005; Toshiba Corp.
JP2005319593 Machine Translation (by EPO and Google) published Nov. 17, 2005, Jujo Paper Co Ltd.

(56) References Cited

OTHER PUBLICATIONS

JP2006095870A Machine Translation (by EPO and Google) published Apr. 13, 2006; Fuji Photo Film Co Ltd.
JP2006143778 Machine Translation (by EPO, PlatPat and Google) published Jun. 8, 2006 Sun Bijutsu Insatsu KK et al.
JP2006152133 Machine Translation (by EPO, PlatPat and Google) published Jun. 15, 2006 Seiko Epson Corp.
JP2006263984 Machine Translation (by EPO, PlatPat and Google) published Oct. 5, 2006 Fuji Photo Film Co Ltd.
JP2006347085 Machine Translation (by EPO and Google) published Dec. 28, 2006 Fuji Xerox Co Ltd.
JP2007041530A Machine Translation (by EPO and Google) published Feb. 15, 2007; Fuji Xerox Co Ltd.
JP2008006816 Machine Translation (by EPO and Google) published Jan. 17, 2008; Fujifilm Corp.
JP2008018716 Machine Translation (by EPO and Google) published Jan. 31, 2008; Canon Inc.
JP2008201564 Machine Translation (English machine translation) published Sep. 4, 2008 Fuji Xerox Co Ltd.
JP2008246990 Machine Translation (by EPO and Google) published Oct. 16, 2008, Jujo Paper Co Ltd.
JP2009045885A Machine Translation (by EPO and Google) published Mar. 5, 2009; Fuji Xerox Co Ltd.
JP2009083314 Machine Translation (by EPO, PlatPat and Google) published Apr. 23, 2009 Fujifilm Corp.
JP2009096175 Machine Translation (EPO, PlatPat and Google) published on May 7, 2009 Fujifilm Corp.
JP2009148908A Machine Translation (by EPO and Google) published Jul. 9, 2009; Fuji Xerox Co Ltd.
JP2010184376 Machine Translation (by EPO, PlatPat and Google) published Aug. 26, 2010 Fujifilm Corp.
JP2010214885A Machine Translation (by EPO and Google) published Sep. 30, 2010; Mitsubishi Heavy Ind Ltd.
JP2010228192 Machine Translation (by PlatPat English machine translation) published Oct. 14, 2010 Fuji Xerox.
JP2010258193 Machine Translation (by EPO and Google) published Nov. 11, 2010; Seiko Epson Corp.
JP2010260204A Machine Translation (by EPO and Google) published Nov. 18, 2010; Canon KK.
JP2010260287 Machine Translation (by EPO and Google) published Nov. 18, 2010, Canon KK.
JP2011144271 Machine Translation (by EPO and Google) published Jun. 28, 2011 Toyo Ink SC Holdings Co Ltd.
JP2011186346 Machine Translation (by PlatPat English machine translation) published Sep. 22, 2011 Seiko Epson Corp, Nishimura et al.
JP2011189627 Machine Translation (by Google Patents) published Sep. 29, 2011; Canon KK.
JP2011201951A Machine Translation (by PlatPat English machine translation); published on Oct. 13, 2011, Shinetsu Chemical Co Ltd, Todoroki et al.
JP2011224032 Machine Translation (by EPO & Google) published Jul. 5, 2012 Canon KK.
JP2013001081 Machine Translation (by EPO and Google) published Jan. 7, 2013; Kao Corp.
JP2013060299 Machine Translation (by EPO and Google) published Apr. 4, 2013; Ricoh Co Ltd.
JP2013103474 Machine Translation (by EPO and Google) published May 30, 2013; Ricoh Co Ltd.
JP2013121671 Machine Translation (by EPO and Google) published Jun. 20, 2013; Fuji Xerox Co Ltd.
JP2013129158 Machine Translation (by EPO and Google) published Jul. 4, 2013; Fuji Xerox Co Ltd.
JP2529651B2 Machine Translation (by EPO and Google) issued Aug. 28, 1996;Osaka Sealing Insatsu KK.
JPH05147208 Machine Translation (by EPO and Google) published Jun. 15, 1993Mita Industrial Co Ltd.
JPH06100807 Machine Translation (by EPO and Google) published Apr. 12, 1994; Seiko Instr Inc.
JPH07238243A Machine Translation (by EPO and Google) published Sep. 12, 1995; Seiko Instr Inc.
JPH08112970 Machine Translation (by EPO and Google) published May 7, 1996; Fuji Photo Film Co Ltd.
JPH0862999A Machine Translation (by EPO & Google) published Mar. 8, 1996 Toray Industries, Yoshida, Tomoyuki.
JPH09123432 Machine Translation (by EPO and Google) published May 13, 1997, MITA Industrial Co Ltd.
JPH09281851A Machine Translation (by EPO and Google) published Oct. 31, 1997; Seiko Epson Corp.
JPH11106081A Machine Translation (by EPO and Google) published Apr. 20, 1999; Ricoh KK.
JPS567968 Machine Translation (by PlatPat English machine translation); published on Jun. 28, 1979, Shigeyoshi et al.
JPS6076343A Machine Translation (by EPO and Google) published Apr. 30, 1985; Toray Industries.
Machine Translation (by EPO and Google) of JPH07112841 published on May 2, 1995 Canon KK.
"Solubility of Alcohol", in http://www.solubilityoflhings.com/water/alcohol; downloaded on Nov. 30, 2017.
Poly(vinyl acetate) data sheet. PolymerProcessing.com. Copyright 2010. http://polymerprocessing .com/polymers/PV AC.html.
RU2180675 Machine Translation (by EPO and Google) published Mar. 20, 2002; Zao Rezinotekhnika.
RU2282643 Machine Translation (by EPO and Google) published Aug. 27, 2006; Balakovorezinotekhnika Aoot.
Flexicon., "Bulk Handling Equipment and Systems: Carbon Black," 2018, 2 pages.
JP2004524190A Machine Translation (by EPO and Google) published Aug. 12, 2004; Avery Dennison Corp.
JP2010234681A Machine Translation (by EPO and Google) published Oct. 21, 2010; Riso Kagaku Corp.
JP2010260302A Machine Translation (by EPO and Google) published Nov. 18, 2010; Riso Kagaku Corp.
JPS60199692A Machine Translation (by EPO and Google) published Oct. 9, 1985; Suwa Seikosha KK.
Montuori G.M., et al., "Geometrical Patterns for Diagrid Buildings: Exploring Alternative Design Strategies From the Structural Point of View," Engineering Structures, Jul. 2014, vol. 71, pp. 112127.
The Engineering Toolbox., "Dynamic Viscosity of Common Liquids," 2018, 4 pages.
WO2006051733A1 Machine Translation (by EPO and Google) published May 18, 2006; Konica Minolta Med & Graphic.
CN1809460A Machine Translation (by EPO and Google) published Jul. 26, 2006; Canon KK.
JP2007253347A Machine Translation (by EPO and Google) published Oct. 4, 2007; Ricoh KK, Matsuo et al.
Thomas E. F., "CRC Handbook of Food Additives, Second Edition, vol. 1" CRC Press LLC, 1972, p. 434.
Units of Viscosity published by Hydramotion Ltd. 1 York Road Park, Malton, York Y017 6YA, England; downloaded from www.hydramotion.com website on Jun. 19, 2017.
JP2016185688A Machine Translation (by EPO and Google)—published Oct. 27, 2016; Hitachi Industry Equipment Systems Co Ltd.
JPH03248170A Machine Translation (by EPO & Google)—published Nov. 6, 1991; Fujitsu Ltd.
CN101073937A Machine Translation (by EPO and Google)—published Nov. 21, 2007; Werner Kaman Maschinen Gmbh & [DE].
CN101344746A Machine Translation (by EPO and Google)—published Jan. 14, 2009; Ricoh KK [JP].
CN102648095A Machine Translation (by EPO and Google)—published Aug. 22, 2012; Mars Inc.
CN1121033A Machine Translation (by EPO and Google)—published Apr. 24, 1996; Kuehnle Manfred R [US].
CN1212229A Machine Translation (by EPO and Google)—published Mar. 31, 1999; Honta Industry Corp [JP].
CN201410787Y Machine Translation (by EPO and Google)—published Feb. 24, 2010; Zhejiang Chanx Wood Co Ltd.
Co-pending U.S. Appl. No. 16/512,915, filed Jul. 16, 2019.
Co-pending U.S. Appl. No. 16/542,362, filed Aug. 16, 2019.
Co-pending U.S. Appl. No. 16/590,397, filed Oct. 2, 2019.
Co-pending U.S. Appl. No. 16/677,732, filed Nov. 8, 2019.

(56) References Cited

OTHER PUBLICATIONS

IP.com Search, 2019, 1 page.
JP2000108334A Machine Translation (by EPO and Google)—published Apr. 18, 2000; Brother Ind Ltd.
JP2002103598A Machine Translation (by EPO and Google)—published Apr. 9, 2002; Olympus Optical Co.
JP2006224583A Machine Translation (by EPO and Google)—published Aug. 31, 2006; Konica Minolta Holdings Inc.
JP2006231666A Machine Translation (by EPO and Google)—published Sep. 7, 2006; Seiko Epson Corp.
JP2008137239A Machine Translation (by EPO and Google); published on Jun. 19, 2008, Kyocera Mita Corp.
JP2008139877A Machine Translation (by EPO and Google)—published Jun. 19, 2008; Xerox Corp.
JP2008194997A Machine Translation (by EPO and Google)—published Aug. 28, 2008; Fuji Xerox Co Ltd.
JP2008238674A Machine Translation (by EPO and Google)—published Oct. 9, 2008; Brother Ind Ltd.
JP2009045851A Machine Translation (by EPO and Google); published on Mar. 5, 2009, Fujifilm Corp.
JP2010234599A Machine Translation (by EPO and Google)—published Oct. 21, 2010; Duplo Seiko Corp et al.
JP2010247381A Machine Translation (by EPO and Google); published on Nov. 4, 2010, Ricoh Co Ltd.
JP2011037070A Machine Translation (by EPO and Google)—published Feb. 24, 2011; Riso Kagaku Corp.
JP2011126031A Machine Translation (by EPO and Google); published on Jun. 30, 2011, Kao Corp.
JP2012196787A Machine Translation (by EPO and Google)—published Oct. 18, 2012; Seiko Epson Corp.
JP2014094827A Machine Translation (by EPO and Google)—published May 22, 2014; Panasonic Corp.
JPH06345284A Machine Translation (by EPO and Google); published on Dec. 20, 1994, Seiko Epson Corp.
JPH07186453A Machine Translation (by EPO and Google)—published Jul. 25, 1995; Toshiba Corp.
JPS5578904A Machine Translation (by EPO and Google)—published Jun. 14, 1980; Yokoyama Haruo.
Technical Information Lupasol Types, Sep. 2010, 10 pages.
WO2010073916A1 Machine Translation (by EPO and Google)—published Jul. 1, 2010; Nihon Parkerizing [JP] et al.

* cited by examiner

INDIRECT PRINTING SYSTEM

FIELD OF THE INVENTION

The invention relates to an indirect printing system having an intermediate transfer member (ITM) in the form of an endless belt for transporting ink images from an image forming station, where the ink images are deposited on an outer surface of the ITM by at least one print bar, to an impression station where the ink images are transferred from the outer surface of the ITM onto a printing substrate.

BACKGROUND OF THE INVENTION

An example of a digital printing system as set out above is described in detail in WO 2013/132418 which discloses use of a water-based ink and an ITM having a hydrophobic outer surface.

In indirect printing systems, it is common to wrap the ITM around a support cylinder or drum and such mounting ensures that, at the image forming station, the distance of the ITM from the print bars does not vary. Where, however, the ITM is a driven flexible endless belt passing over drive rollers and tensioning rollers, it is useful to take steps to ensure that the ITM does not flap up and down, or is otherwise displaced, as it passes through the image forming station and that its distance from the print bars remains fixed.

In WO 2013/132418, the ITM is supported in the image forming station on a flat table and it is proposed to use negative air pressure and lateral belt tensioning to maintain the ITM in contact with its support surface. In some systems, employing such construction may create a high level of drag on the ITM as it passes through the image forming station.

In WO 2013/132418, it is also taught that to assist in guiding the belt smoothly, friction may be reduced by passing the belt over rollers adjacent each print bar instead of sliding the belt over stationary guide plates. The rollers need not be precisely aligned with their respective print bars. They may be located slightly (e.g. few millimeters) downstream of the print head jetting location. Frictional forces are used to maintain the belt taut and substantially parallel to print bars. To achieve this, the underside of the belt has high frictional properties and the lateral tension is applied by the guide channels sufficiently to maintain the belt flat and in contact with rollers as it passes beneath the print bars.

Some systems rely on lateral tension to maintain the belt in frictional engagement with the rollers to prevent the belt from lifting off the rollers at any point across. Nevertheless, in some systems, this may increase (even severely) the drag on the belt and wear of the guide channels.

SUMMARY

By supporting the ITM during its passage through the image forming station without severely increasing the drag on the ITM, it is possible to avoid flapping of the ITM, thereby maintaining its surface at a fixed predetermined distance from the print bars. This may be accomplished by a plurality of support rollers that have a common flat tangential plane and contact the inner surface of the ITM.

According to embodiments of the present invention, there is provided an indirect printing system having an intermediate transfer member (ITM) in the form of a circulating endless belt for transporting ink images from an image forming station, where the ink images are deposited on an outer surface of the ITM by at least one print bar, to an impression station where the ink images are transferred from the outer surface of the ITM onto a printing substrate, wherein the outer surface of the ITM is maintained within the image forming station at a predetermined distance from the at least one print bar by means of a plurality of support rollers that have a common flat tangential plane and contact the inner surface of the ITM, and wherein the inner surface of the ITM is attracted to the support rollers, the attraction being such that the area of contact between the ITM and each support roller is greater on the downstream side than the upstream side of the support roller, referenced to the direction of movement of the ITM. The attraction of the ITM to each support roller is sufficient to cause the section of the ITM disposed immediately downstream of the support roller to be deflected downwards, away from the common tangential plane of the support rollers.

In some embodiments of the invention, the inner surface of the ITM and the outer surface of each support roller are formed of materials that tackily adhere to one another, adhesion between the outer surface of each support roller and the inner surface of the ITM serving to prevent the ITM from separating from the support rollers, during operation, when the belt circulates.

The support rollers may have smooth or rough outer surfaces and the inner surface of the ITM may be formed of, or coated with, a material that tackily adheres to the surfaces of the support rollers.

The material on the inner surface of the ITM may be a tacky silicone-based material, which may be optionally supplemented with filler particles to improve its mechanical properties.

In some embodiments of the invention, the attraction between the inner surface of the ITM and the support rollers may be caused by suction. Each support roller may have a perforated outer surface, communicating with a plenum within the support roller that is connected to a vacuum source, so that negative pressure attracts the inner surface of the ITM to the rollers. A stationary shield may surround, or line, part of the circumference of each support roller so that suction is only applied to the side of the roller facing the ITM.

In some embodiments of the invention, the attraction between the support rollers and the ITM may be magnetic. In such embodiments, the inner surface of the ITM may be rendered magnetic (in the same way as fridge magnets) so as to be attracted to ferromagnetic support rollers. Alternatively, the inner surface of the ITM may be loaded with ferromagnetic particles so as to be attracted to magnetized support rollers.

Each print bar may be associated with a respective support roller and the position of the support roller in relation to the print bar may be such that, during operation, ink is deposited by the print bar onto the ITM along a narrow strip upstream from the contact area between the ITM and the support roller.

A shaft or linear encoder may be associated with one or more of the support rollers, to determine the position of the ITM in relation to the print bars.

According to some embodiments, each print bar is associated with a respective support roller and the position of the associated support roller in relation to the print bar is such that, during operation, ink is deposited by the print bar onto the ITM along a narrow strip upstream from the contact area between the ITM and the support roller.

According to some embodiments a shaft or linear encoder is associated with one or more of the support rollers to determine the position of the ITM in relation to the print bars.

According to some embodiments, the indirect printing system comprises a plurality of the print bars such that a different respective support roller is located below and vertically aligned with each print bar of the plurality of print bars.

According to some embodiments, for each given print bar of the plurality of print bars, a respective vertically-aligned support roller is disposed slightly downstream of the given print bar.

According to some embodiments, each given support roller of the plurality of support rollers is associated with a respective rotational-velocity measurement device and/or a respective encoder for measuring a respective rotational-velocity of the given support roller.

An indirect printing system having an intermediate transfer member (ITM) in the form of a circulating endless belt for transporting ink images from an image forming station is now disclosed. According to embodiments of the invention, the ink images are deposited on an outer surface of the ITM by at a plurality of print bars, to an impression station where the ink images are transferred from the outer surface of the ITM onto a printing substrate, wherein the outer surface of the ITM is maintained within the image forming station at a predetermined vertical distance from the print bars by a plurality of support rollers that have a common flat tangential plane and contact the inner surface of the ITM, the support rollers being disclosed such that a different respective support roller is located below and vertically aligned with each print bar of the plurality of print bars, wherein each given support roller of the plurality of support rollers is associated with a respective rotational-velocity measurement device and/or a respective encoder for measuring a respective rotational-velocity of the given support roller.

According to some embodiments, for each given print bar of the plurality of print bars, a respective vertically-aligned support roller is disposed slightly downstream of the given print bar.

According to some embodiments, the indirect printing system further comprises: droplet-deposition control circuitry configured to regulate, for each given print bar of the plurality of print bars, a respective rate of ink droplet deposition DR onto the ITM, the droplet-deposition control circuitry regulating the ink droplet deposition rates in accordance with and in response to the measured of the rotational velocity of a respective support rollers that is vertically aligned with the given print bar.

In some embodiments, the measurement device and/or the encoder is attached (i.e. directly or indirectly attached) to its respective roller (e.g. via a shaft thereof).

According to some embodiments, for upstream and downstream print bars respectively vertically aligned with upstream and downstream support rollers, the droplet-deposition control circuit regulates the respective $DR_{UPSTREAM}$, $DR_{DOWNSTREAM}$ deposition rates at upstream and downstream print bars so that a difference $DR_{UPSTREAM}-DR_{DOWNSTREAM}$ between respective ink-droplet-deposition-rates at upstream and downstream print bars is regulated according to a difference function between function $F=\omega_{UPSTREAM}*R_{UPSTREAM}-\omega_{DOWNSTREAM}*R_{DOWNSTREAM}$ where: i. $\omega_{UPSTREAM}$ is the measured rotation rate of the upstream-printbar-aligned support roller as measured by its associated rotational-velocity measurement device or encoder; ii. $R_{UPSTREAM}$ is the radius of the upstream-printbar-aligned support roller; $\omega_{DOWNSTREAM}$ is the measured rotation rate of the downstream-printbar-aligned support roller as measured by its associated rotational-velocity measurement device or encoder; and ii. $R_{DOWNSTREAM}$ is the radius of the upstream-printbar-aligned support roller.

BRIEF DESCRIPTION OF THE DRAWING

The invention will now be described further, by way of example, with reference to the accompanying drawings, in which.

Figure 1:
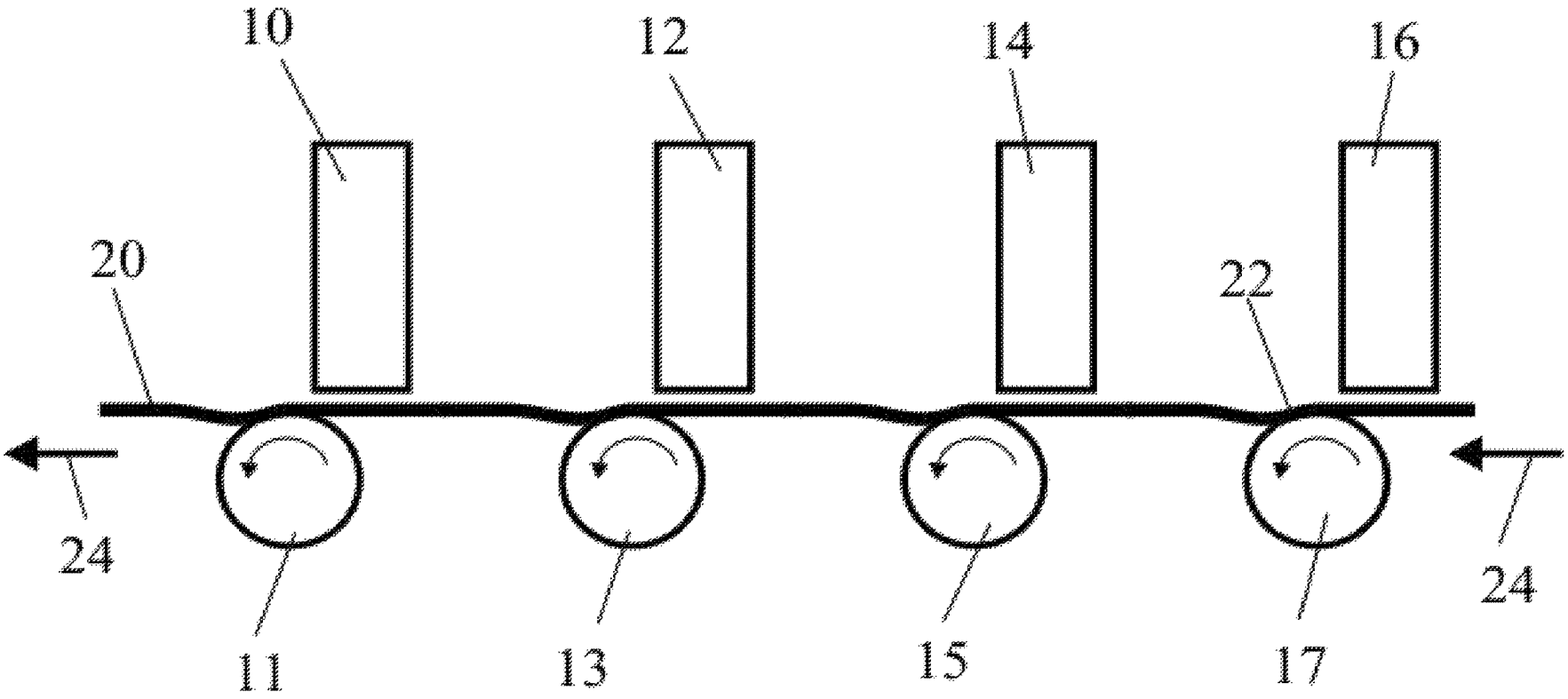
FIGS. 1, 3 and 4 each schematically illustrate an image transfer member passing beneath four print bars of an image forming station.

It will be appreciated that the drawings area only intended to explain the principles employed in the present invention and illustrated components may not be drawn to scale.

DETAILED DESCRIPTION OF THE DRAWING

FIG. 1 shows an image transfer member (ITM) 20 passing beneath four print bars 10, 12, 14, 16 of an image forming station of a digital printing system, for example of the kind described in WO 2013/132418. The print bars 10, 12, 14, 16 deposit ink droplets onto the ITM which are dried while being transported by the ITM and are transferred to a substrate at an impression station (not shown). The direction of movement of the ITM from the image forming station to the impression station, illustrated by arrow 24 in the drawing, is also termed the printing direction. The terms upstream and downstream are used herein to indicate the relative position of elements with reference to such printing direction.

Multiple print bars can be used either for printing in multiple colors, for example CMYK in the case of the four print bars shown in the drawing, or to increase printing speed when printing in the same color. In either case, accurate registration is required between the ink droplets deposited by different print bars and for this to be achieved it is necessary to ensure that the ITM lie in a well defined plane when ink is being deposited onto its surface.

In the illustrated embodiment, cylindrical support rollers 11, 13, 15 and 17 are positioned immediately downstream of the respective bars 10, 12, 14 and 16. A common horizontal plane, spaced form the print bars by a desired predetermined distance, is tangential to all the support rollers. The rollers 11, 13, 15 and 17 contact the underside of the ITM 20, that is to say the side facing away from the print bars.

To ensure that the ITM 20 does not flap as it passes over the rollers 11, 13, 15 and 17, the rollers in FIG. 1 may have smoothly polished surfaces and the underside of the ITM may be formed of, or coated with, a soft conformable silicone-based material that tackily adheres to smooth surfaces. Such materials are well known and are in a wide commercial use, for example, in children's toys. There are for example figures made of such materials that will adhere to a vertical glass pane when pressed against it.

Because of the tacky contact between the ITM 20 and the roller 11, 13, 15 and 17, it will be seen in the drawing that the ITM is deflected downwards from the notional horizontal tangential plane on the downstream or exit side of each roller 11, 13, 15 and 17.

Thus, the contact area 22 between the ITM 20 and each roller 11, 13, 15 and 17, lies predominantly on the downstream, or exit, side of the roller. The tension applied to the ITM in the printing direction ensures that the ITM returns to the desired plane before it reaches the subsequent print bar 10, 12, or 14.

The sticking of the ITM 20 to the support rollers is relied upon to ensure that the ITM does not lift off the rollers. As the rollers are supported on bearings and are free to rotate smoothly, the only drag on the ITM, other than the force required to overcome the resistance of the bearing and maintain the momentum of the support rollers, is the small force required to separate the tacky underside of the ITM from each of the support rollers 11, 13, 15 and 17.

The regions of the ITM in contact with the uppermost points on each roller 11, 13, 15 and 17 and the regions immediately upstream of each roller lie in the nominal tangential plane and can be aligned with the print bars 10, 12, 14 and 16. However, if any foreign body, such as a dirt particle, should adhere to the tacky underside of the ITM 20 it will cause the upper surface of the ITM to bulge upwards as it passes over a support roller. For this reason, it is preferred to position the print bars 10, 12, 14 and 16 upstream of the vertical axial plane of the rollers 11, 13, 15 and 17, that is to say offset upstream from regions of the ITM in contact with the rollers.

If the tacky adhesion between the ITM 20 and the support rollers 11, 13, 15 and 17 is excessive, it can result in drag and wear of the ITM 20. It is possible to moderate the degree of drag by suitable selection of the hardness of the tacky material or by modification of the roughness of the support rollers 11, 13, 15 and 17.

The attraction in FIG. 1 between the ITM 20 and the support rollers 11, 13, 15 and 17 may rely on magnetism instead of tackiness. In such embodiments, the inner surface of the ITM 20 may be rendered magnetic so as to be attracted to ferromagnetic support rollers 11, 13, 15 and 17. Alternatively, the inner surface of the ITM 20 may be loaded with ferromagnetic particles so as to be attracted to magnetized support rollers 11, 13, 15 and 17.

Figure 2:
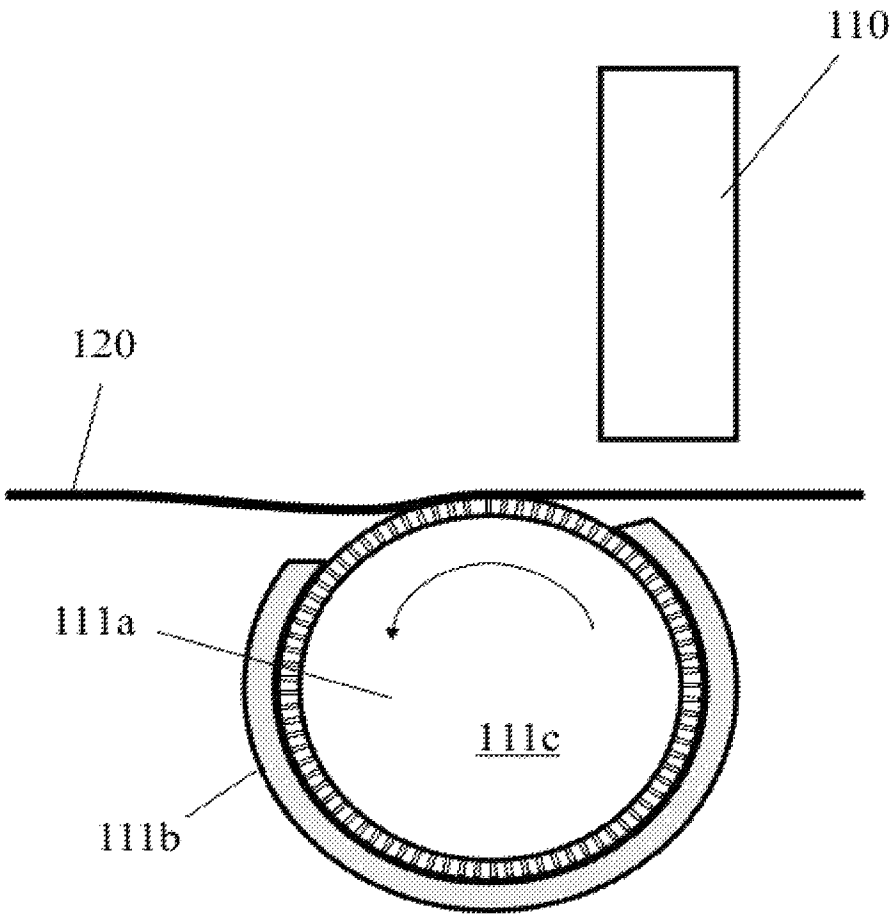
FIG. 2 is a section through an embodiment in which the ITM is attracted to a support roller by application of negative pressure from within the support roller.

FIG. 2 shows schematically a further alternative embodiment in which the attraction between the inner surface of the ITM 120 and a support roller assembly generally designated 111 is the result of negative pressure applied through the support roller assembly 111 to the inner surface of the ITM 120 while the outer surface of the ITM 120 is under atmospheric pressure.

The illustrated support roller assembly 111 comprises a support roller 111*a* surrounded around a major part of its circumference by a stationary shield 111*b*. The roller 111*a* has a perforated surface and is hollow, its inner plenum 111*c* being connected to a vacuum source. The function of the shield 111*b* is to prevent the vacuum in the support roller 111*a* from being dissipated and to concentrate all the suction in the arc of the support roller 111*a* adjacent to and facing the inner surface of the ITM 120. Seals may be provided between the support roller 111*a* and the shield 111*b* to prevent air from entering into the plenum 111*c* through other than the exposed arc of the support roller 111*a*.

As an alternative to a shield 111*b* surrounding the outside of the support roller 111*a*, it would be possible to provide a stationary shield lining the interior of the support roller 111*a*.

Figure 3:
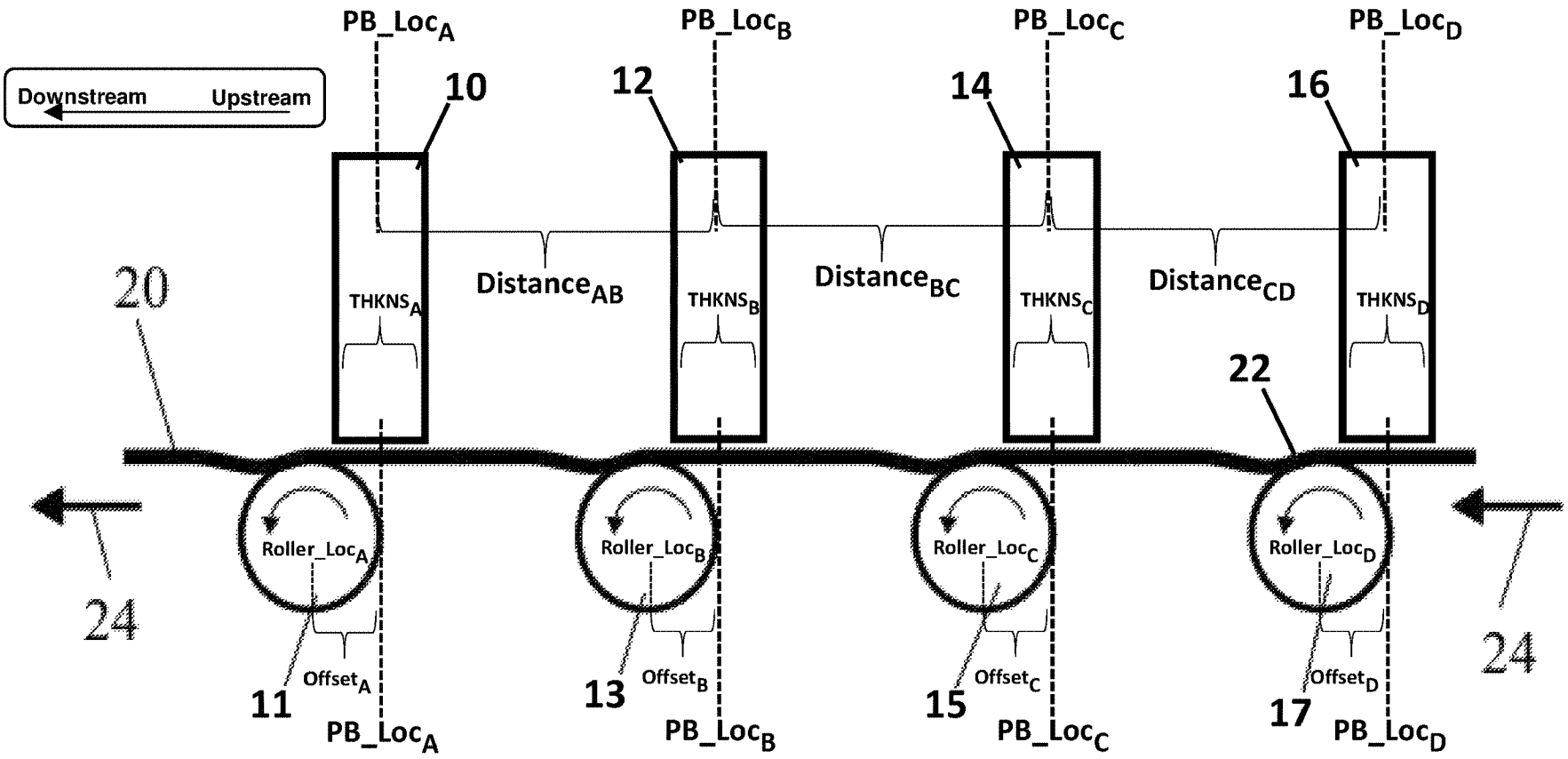

FIG. 3 illustrates the same system illustrated in FIG. 1 comprising print bars 10, 12, 14 and 16 respectively having (i) centers whose positions are labelled as $PB_Loc_A$, $PB_Loc_B$, $PB_Loc_C$, and $PB_Loc_D$, where PB is an abbreviation for "Print Bar" and Loc is an abbreviation for "Locations"; and (ii) thicknesses that are labelled as $THKNS_A$, $THKNS_B$, $THKNS_C$, and $THKNS_D$. The distances between neighboring print bars are labelled as $Distance_{AB}$, $Distance_{BC}$, and $Distance_{CD}$.

The 'center' of a print bar is a vertical plane oriented in the cross-print direction.

In some embodiments, $THKNS_A=THKNS_B=THKNS_C=THKNS_D$, though this is not a limitation, and in other embodiments there may be a variation in print bar thickness.

In some embodiments, the print bars are evenly spaced so that $Distance_{AB}=Distance_{BC}=Distance_{CD}$—once again, this is not a limitation and in other embodiments the distances between neighboring print bars may vary.

In some embodiments, each print bar is associated with a respective support roller that is located below the support roller and vertically aligned with the support roller.

For the present disclosure, when a support roller 13 is 'vertically aligned' with an associated print bar 12, a center of the support roller 13 may be exactly aligned (i.e. in the print direction illustrated by 24) with the centerline $PB_LOC_B$ of the associated print bar 12. Alternatively, if there is a 'slight' horizontal displacement/offset in the print direction (e.g. a downstream offset of the support roller relative to its associated print bar) between the center of the support roller 13 and a center of the associated print bar 12, the print bar 12 and support roller 13 are still considered to be 'vertically aligned' with each other.

FIG. 3 illustrates horizontal displacements/offsets $Offset_A$, $Offset_B$, $Offset_C$, and $Offset_D$ in the print direction between center of each print bar 10, 12, 14, 16 and its respective support roller 11, 13, 15 and 17. However, because the print bars and the support rollers are 'vertically aligned'; this displacement/offset is at most 'slight.' The term 'slight' or 'slightly displaced/offset' (used interchangeably) are defined below.

In the non-limiting example, all of the support rollers have a common radius—this is not a limitation, and embodiments where the radii of the support rollers differ are also contemplated.

In one particular example, the radius of each support roller 11, 13, 15, and 17 is 80 mm, the center-center distance ($Distance_{AB}=Distance_{BC}=Distance_{CD}$) between neighboring pairs of print bars is 364 mm, the thickness ($THKNS_A=THKNS_B=THKNS_C=THKNS_D$) of each print bar is 160 mm, and the offset distances ($Offset_A=Offset_B=Offset_C=Offset_D$.) between the center of the print bar and the center of its associated roller is 23 mm.

Print bars 10 and 16 are 'end print bars' which each have only a single neighbor—the neighbor of print bar 10 is print bar 12 and the neighbor of print bar 16 is print bar 14. In contrast, print bars 12, 14 are 'internal print bars' having two neighbors. Each print bar is associated with a closest neighbor distance—for print bar 10 this is $Distance_{AB}$, for print bar 12 this is $MIN(Distance_{AB}, Distance_{BC})$ where MIN denotes the minimum, for print bar 14 this is $MIN(Distance_{BC}, Distance_{CD})$ and for print bar 16 this is $Distance_{CD}$.

For the present disclosure, when the support roller is 'slightly displaced/offset' from its associated print bar, this means that a ratio $\alpha$ between the (i) the offset/displacement distance "Offset" defined by the centers of the support roller and the print bar and (ii) the closest neighbor distance of the print bar is at most 0.25. In some embodiments, the ratio $\alpha$ is at most 0.2 or at most 0.15 or at most 0.1. In the particular example described above, the ratio $\alpha$ is 23/364=0.06.

In some embodiments, in order to achieve accurate registration between ink droplets deposited by different print bars, it is necessary to monitor and control the position of the ITM not only in the vertical direction but also in the horizontal direction. Because of the adhesive nature of the contact between the rollers and the ITM, the angular position of the rollers can provide an accurate indication of the position of the surface of the ITM in the horizontal direction, and therefore the position of ink droplets deposited by preceding print bars. Shaft encoders may thus suitably be mounted on one or more of the rollers to provide position feedback signals to the controller of the print bars.

In some embodiments, the length of the flexible belt or of portions thereof may fluctuate in time, where the magnitude of the fluctuations may depend upon the physical structure of the flexible belt. In some embodiments, the stretching and contracting of the belt may be non-uniform. In these situations, the local linear velocity of the ITM at each print bar may vary between print bars due to stretching and contracting of the belt or of the ITM in the print direction. Not only may the degree of stretch may be non-uniform along the length of the belt or ITM, but it may temporally fluctuate as well.

Registration accuracy may depend on having an accurate measure of the respective linear velocity of the ITM underneath each print bar. For systems where the ITM is a drum or a flexible belt having temporally constant and spatially uniform stretch (and thus a constant shape), it may be sufficient to measure the ITM speed at a single location.

However, in other systems (e.g. when the ITM stretches and contracts non-uniformly in space and in a manner that fluctuates in time), the linear speed of the ITM under a first print bar 10 at $PB_Loc_A$ may not match the linear speed under a second print bar 12 at $PB_Loc_B$. Thus, if the linear speed of the ITM at the downstream print bar 10 exceeds that of the ITM at the upstream bar 12 this may indicate that the blanket is locally extending (i.e. increasing a local degree of stretch) at locations between the two print bars 10, 12. Conversely, if the linear speed of the ITM at the downstream print bar 10 is less than that of the ITM at the upstream bar 12 this may indicate that the blanket is locally contracting at locations between the two print bars 10, 12.

Registration may thus benefit from obtaining an accurate measurement of the local speed of the ITM at each print bar. Instead of only relying on a single ITM-representative velocity value (i.e. like may be done for a drum), a "print-bar-local" linear velocity of the ITM at each print bar may be measured at a location that is relatively 'close' to the print bar center PB_LOC.

Figure 4:
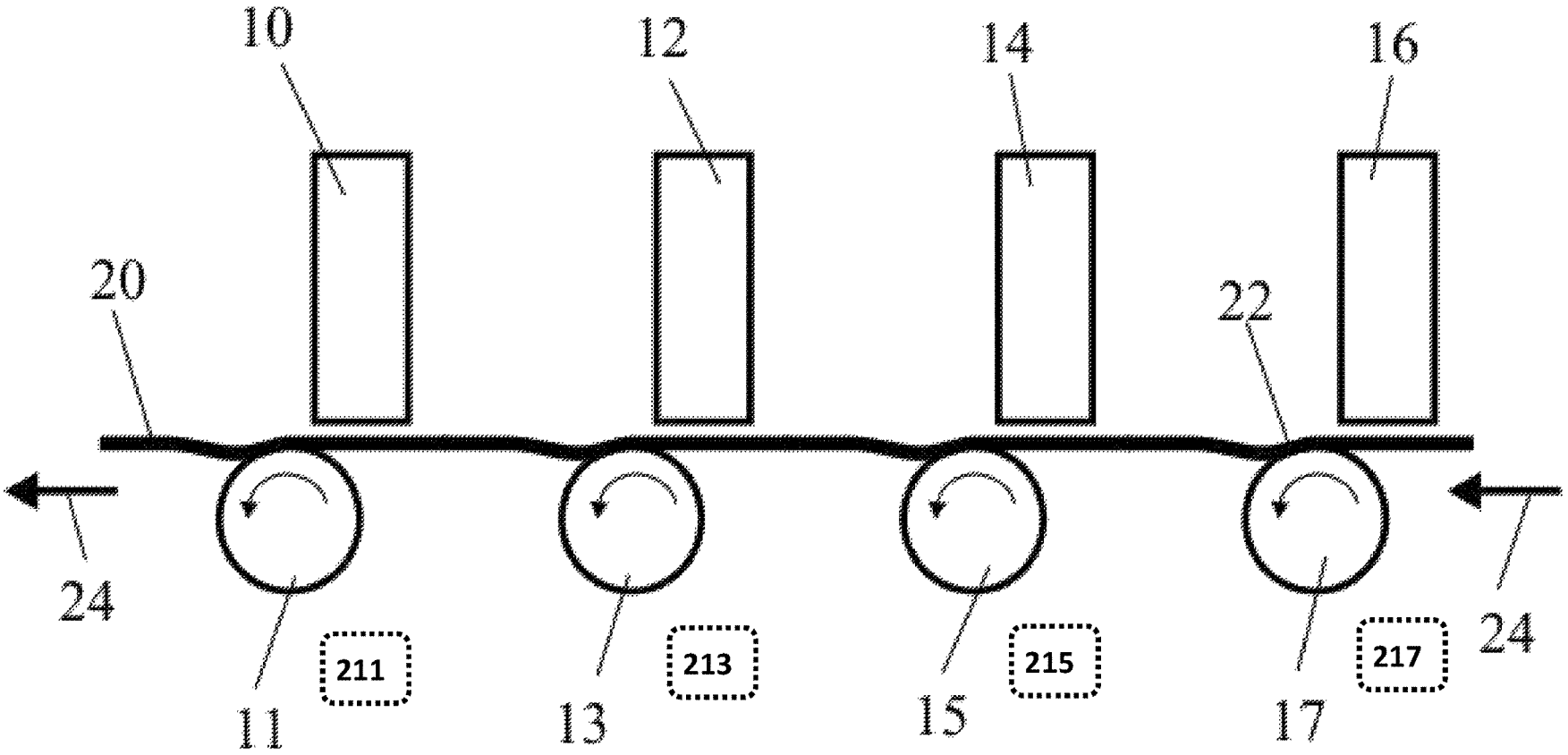

For example, as shown in FIG. 4, a respective device (e.g. for example, a shaft-encoder) 211, 213, 215 or 217 may be used to measure the respective rotational velocity ω of each support roller—this rotational velocity, together with the radius of the support roller, may describe the local linear velocity of each support roller. Because the support roller is vertically aligned with the print bar, this rotational velocity, together with the radius of the support roller, may provide a relatively accurate measurement of the linear velocity of the ITM beneath the print bar.

FIG. 4 illustrates the rotational-velocity measuring device schematically. As is known in the art (e.g. art of shaft encoders), the rotational-velocity measuring device 211, 213, 215 or 217 may including mechanical and/or electrical and/or optical and/or magnetic or any other components to monitor the rotation of the support roller. For example, the rotational-velocity measuring device 211, 213, 215 or 217 may directly monitor rotation of the roller or of a rigid object (e.g. a shaft) that is rigidly attached to the roller and that rotates in tandem therewith.

Because the ITM may be locally stretch or contract over time, depositing ink-droplets only according to a single 'ITM-representative' speed for all print bars may lead to registration errors. Instead, it may be advantageous to locally measure the linear speed of the ITM at each print bar.

Towards this end, the support rollers may serve multiple purposes—i.e. supporting the ITM in a common tangential plane and measuring the speed of the ITM at a location where the ITM is in contact with (e.g, no-slip contact—for example, due the inner surface being attached to the support rollers—for example, due to the presence of a tacky material on the ITM inner surface) with the support roller.

In order for the support roller to provide an accurate measurement of the linear speed of the ITM beneath the print bar, it is desirable to vertically align the support roller with its associated print bar. Towards this end, it is desirable to locate the support roller so the value of the ratio α (defined above) is relatively small.

In some embodiments, a ratio β between (i) the offset/displacement distance "Offset" defined by the centers of the support roller and the print bar and (ii) a thickness TKNS of the print bar is at most 1 or at most 0.75 or at most 0.5 or at most 0.4 or at most 0.3 or at most 0.2. In the example described above, a value of the ratio β is 23 mm/160 mm=0.14.

In some embodiments, a ratio γ between (i) a diameter of the vertically aligned support roller and (ii) a thickness TKNS of the print bar is at most 2 or at most 1.5 or at most 1.25. In the example described above, a value of the ratio β is 160 mm/160 mm=1.

In some embodiments, a ratio δ between (i) a diameter of the vertically aligned support roller and (ii) the closest neighbor distance of the associated print bar at most 1 or at most 0.75 or at most 0.6 or at most 0.5. In the example described above, a value of the ratio β is 160 mm/364 mm=0.44.

Figure 5:
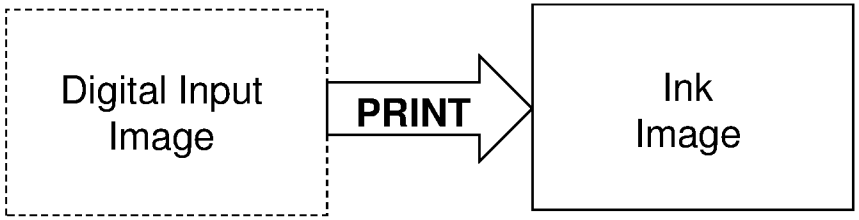
FIG. 5 shows converting a digital input image into an ink image by printing.

FIG. 5 is a generic figure illustrating any printing process—a digital input image is stored in electronic or computer memory (e.g. as a two-dimensional array of gray-scale values) and this 'digital input image' is printed by the printing system to yield an ink image on the ITM.

Each print bar deposits droplets of ink upon the ITM at a respective deposition-rate that depends upon (i) content of the digital input image being printed and (ii) the speed of the ITM as it moves beneath the print bar. The 'deposition rate' is the rate at which ink droplets are deposited on the ITM 20 and has the dimensions of 'number of droplets per unit time' (e.g. droplets per second).

Figure 6:
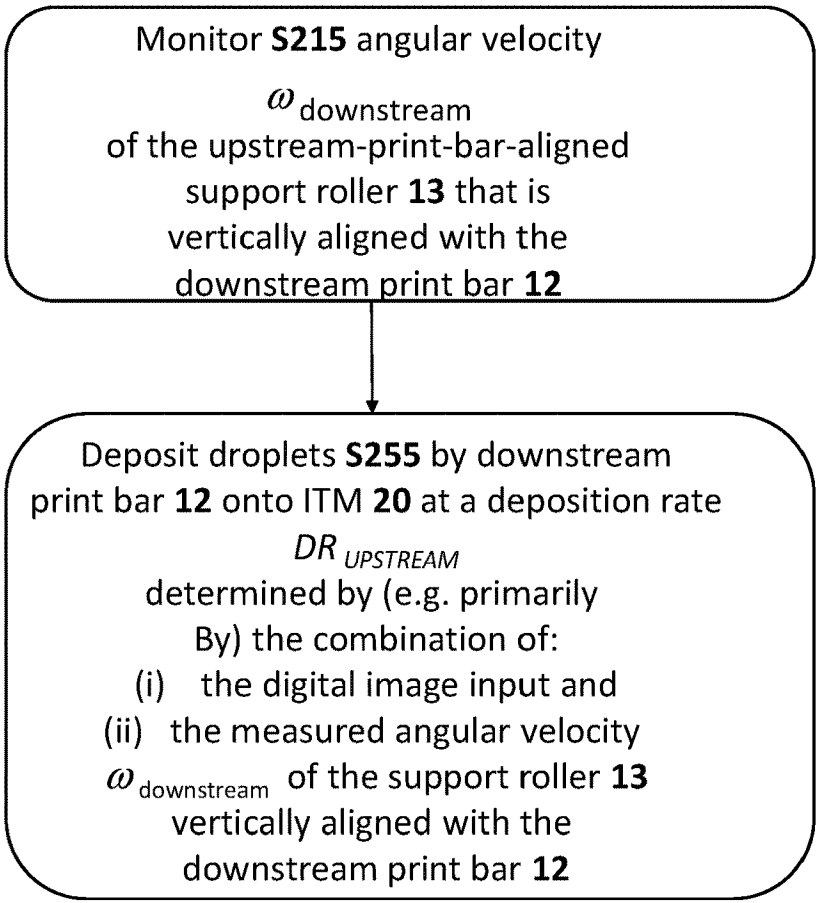
FIGS. 6-8 shows methods for printing by an upstream and a downstream print bar in accordance with angular velocities of support rollers.
Figure 6:
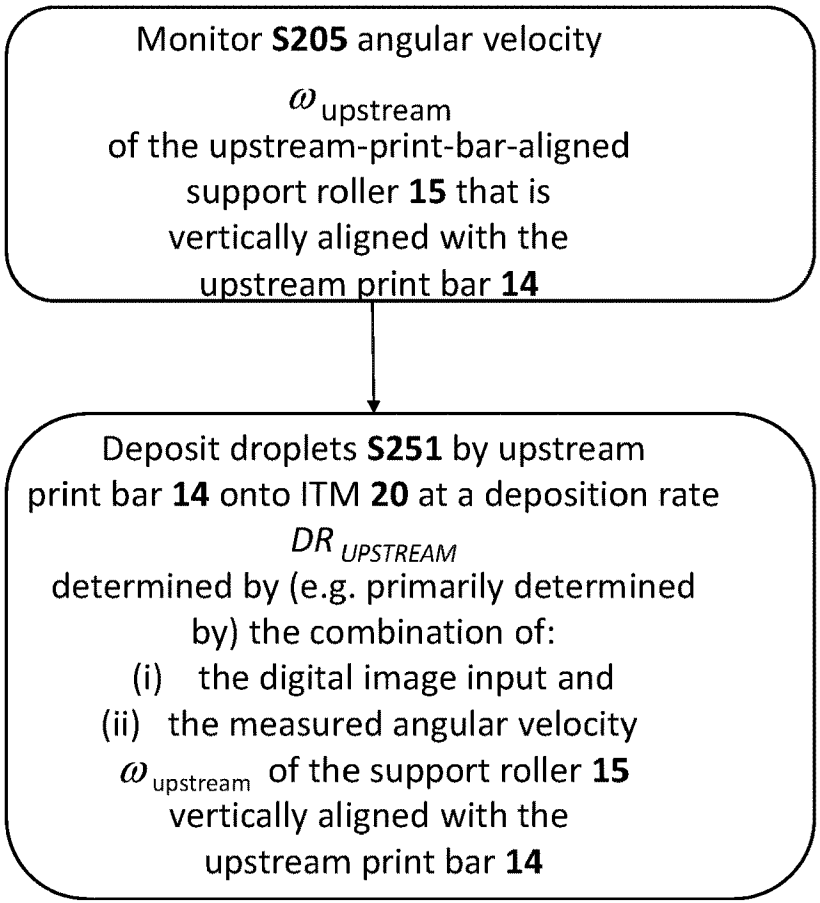

FIG. 6 illustrates a method of operating upstream 14 and downstream 12 print bars according to some embodiments. In step S205, an angular velocity $\omega_{UPSTREAM}$ of support roller 15 is monitored; similarly (e.g. simultaneously), in step S215, an angular velocity $\omega_{DOWNSTREAM}$ of support roller 13 is monitored. In step S251, droplets of ink are deposited on the ITM 20 by upstream print bar 14 at a rate determined (e.g. determined primarily) by the combination of (i) the digital input image; and (ii) $\omega_{UPSTREAM}$. In step S255, droplets of ink are deposited on the ITM 20 by downstream print bar 12 at a rate determined (e.g. determined primarily) by the combination of (i) the digital input image; and (ii) $\omega_{DOWNSTREAM}$.

It is understood that due to temporal fluctuations in non-uniform stretching of the ITM, the linear velocities of the ITM at the upstream 14 and downstream 12 print bars will not always match. These linear velocities may be approximately and respectively monitored by monitoring the linear velocities (i) at the contact location between upstream support roller 15 (i.e. vertically aligned with the upstream 14 print bar) and (ii) at the contact location between downstream support roller 13 (i.e. vertically aligned with the downstream 12 print bar).

Notation—the angular velocity of the upstream support roller 15 is $\omega_{UPSTREAM}$, the angular velocity of the downstream support roller 13 is $\omega_{DOWNSTREAM}$, the linear velocity of the ITM 20 at the contact location between the ITM 20 and the upstream support roller 15 is denoted at $LV_{UPSTREAM}$; the linear velocity of the ITM 20 at the contact location between the ITM 20 and the upstream support roller 15 is denoted at $LV_{UPSTREAM}$. An ink-droplet deposition rate of the upstream 14 print bar is denoted as $DR_{UPSTREAM}$ and an ink-droplet deposition rate of the downstream 12 print bar is denoted as $DR_{DOWNSTREAM}$. $R_{UPSTREAM}$ is the radius of the upstream support roller 15; $R_{DOWNSTREAM}$ is the radius of the downstream support roller 13.

In some embodiments, a rate of ink droplet deposition DR at any of the print bars is regulated by electronic circuitry (e.g. control circuitry). For the present disclosure, the term 'electronic circuitry' (or control circuitry such as droplet-deposition control circuitry) is intended broadly to include any combination of analog circuitry, digital circuitry (e.g. a digital computer) and software.

For example, the electronic circuitry may regulate the ink droplet deposition rate DR according to and in response to electrical input received directly or indirectly (e.g. after processing) from any rotation-velocity measuring device (e.g. shaft-encoder 211, 213, 215 or 217).

For the present paragraph, assume that $LV_{UPSTREAM}$ is equal to the linear velocity of the ITM directly beneath the upstream print bar 14 and that $LV_{DOWNSTREAM}$ is equal to the linear velocity of the ITM directly beneath the downstream print bar 12—this is a good approximation since (i) any horizontal displacement/offset between the upstream print bar 14 and its associated support roller 15 is at most slight; and (ii) any horizontal displacement/offset between the downstream print bar 12 and its associated support roller 13 is at most slight.

When the upstream and downstream linear velocities match (i.e. when $LV_{UPSTREAM}=LV_{DOWNSTREAM}$), the difference ($DR_{UPSTREAM}-DR_{DOWNSTREAM}$) in respective ink-droplet rates at any given time will be determined primarily by (e.g. solely by) the content of the digital input image. Thus, when printing a uniform input image, when the upstream and downstream linear velocities match, this difference ($DR_{UPSTREAM}-DR_{DOWNSTREAM}$) will be zero and each print bar will deposit ink droplets at a common deposition rate difference $DR_{UPSTREAM}=DR_{DOWNSTREAM}$.

However, due to temporal fluctuations in the non-uniform stretch of the ITM, there may be periods of mismatch between the upstream and downstream linear velocities match—i.e. when $LV_{UPSTREAM}\neq LV_{DOWNSTREAM}$. In order to compensate (e.g. for example, when printing a uniform input-image or a uniform portion of a larger input-image), the greater the difference between the upstream and downstream linear velocities, the greater the difference in ink deposition rates—i.e. as the linear velocity difference $LV_{UPSTREAM}-LV_{DOWNSTREAM}$ increases (decreases), the deposition rate difference $DR_{UPSTREAM}-DR_{DOWNSTREAM}$ increases (decreases).

Assuming no-slip between the ITM 20 and the upstream support roller 15, the magnitude of $LV_{UPSTREAM}$ is the product $\omega_{UPSTREAM}*R_{UPSTREAM}$. Assuming no-slip between the ITM 20 and the downstream support roller 13, the magnitude of $LV_{DOWNSTREAM}$ is the product $\omega_{DOWNSTREAM}*R_{DOWNSTREAM}$. The linear velocity difference $LV_{UPSTREAM}-LV_{DOWNSTREAM}$ is given by $\omega_{UPSTREAM}*R_{UPSTREAM}-\omega_{DOWNSTREAM}*R_{DOWNSTREAM}$ Therefore, in some embodiments the respective ink droplet depositions rates at the upstream 14 and downstream 12 print bar may regulated so that, for at least some digital input images (e.g. uniform images) the difference therebetween in ink droplet deposition rates $DR_{UPSTREAM}-DR_{DOWNSTREAM}$ increases (decreases) as $\omega_{UPSTREAM}*R_{UPSTREAM}-\omega_{DOWNSTREAM}*R_{DOWNSTREAM}$ (decreases) increases.

Figure 7:
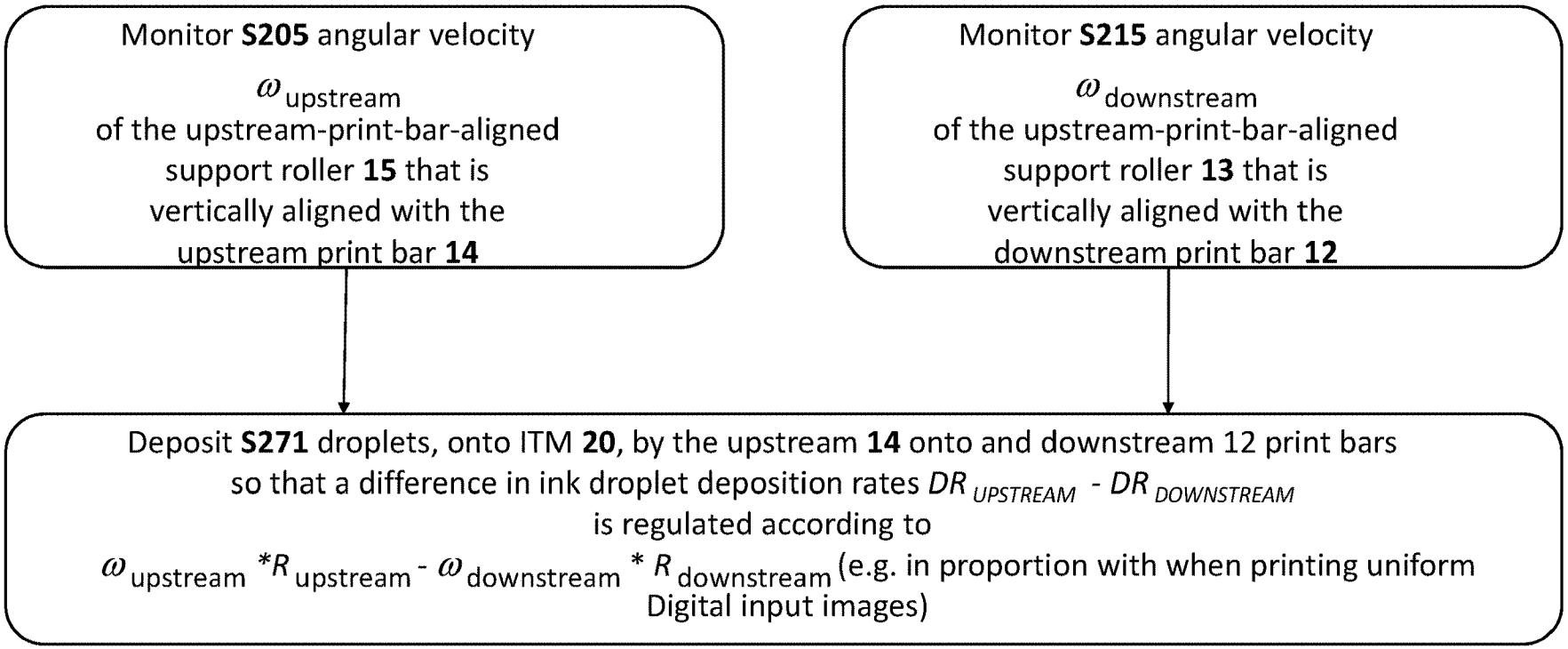

This is illustrated in FIG. 7 where (i) steps S205 and S215 are as in FIG. 6 and (ii) in step S271 droplets are deposited onto ITM 20, by the upstream 14 onto and downstream 12 print bars so that a difference in ink droplet deposition rates $DR_{UPSTREAM}-DR_{DOWNSTREAM}$ is regulated according to $\omega_{upstream}*R_{upstream}-\omega_{downstream}*R_{downstream}$. In one example (e.g. when printing uniform digital input images or uniform portions of a non-uniform digital image), the difference in ink droplet deposition rates $DR_{UPSTREAM}-DR_{DOWNSTREAM}$ in proportion with $\omega_{upstream}*R_{upstream}-\omega_{downstream}*R_{downstream}$. In this example, whenever $\omega_{upstream}*R_{upstream}-\omega_{downstream}*R_{downstream}$ increases (decreases), $DR_{UPSTREAM}-DR_{DOWNSTREAM}$ increases (decreases).

Figure 8:
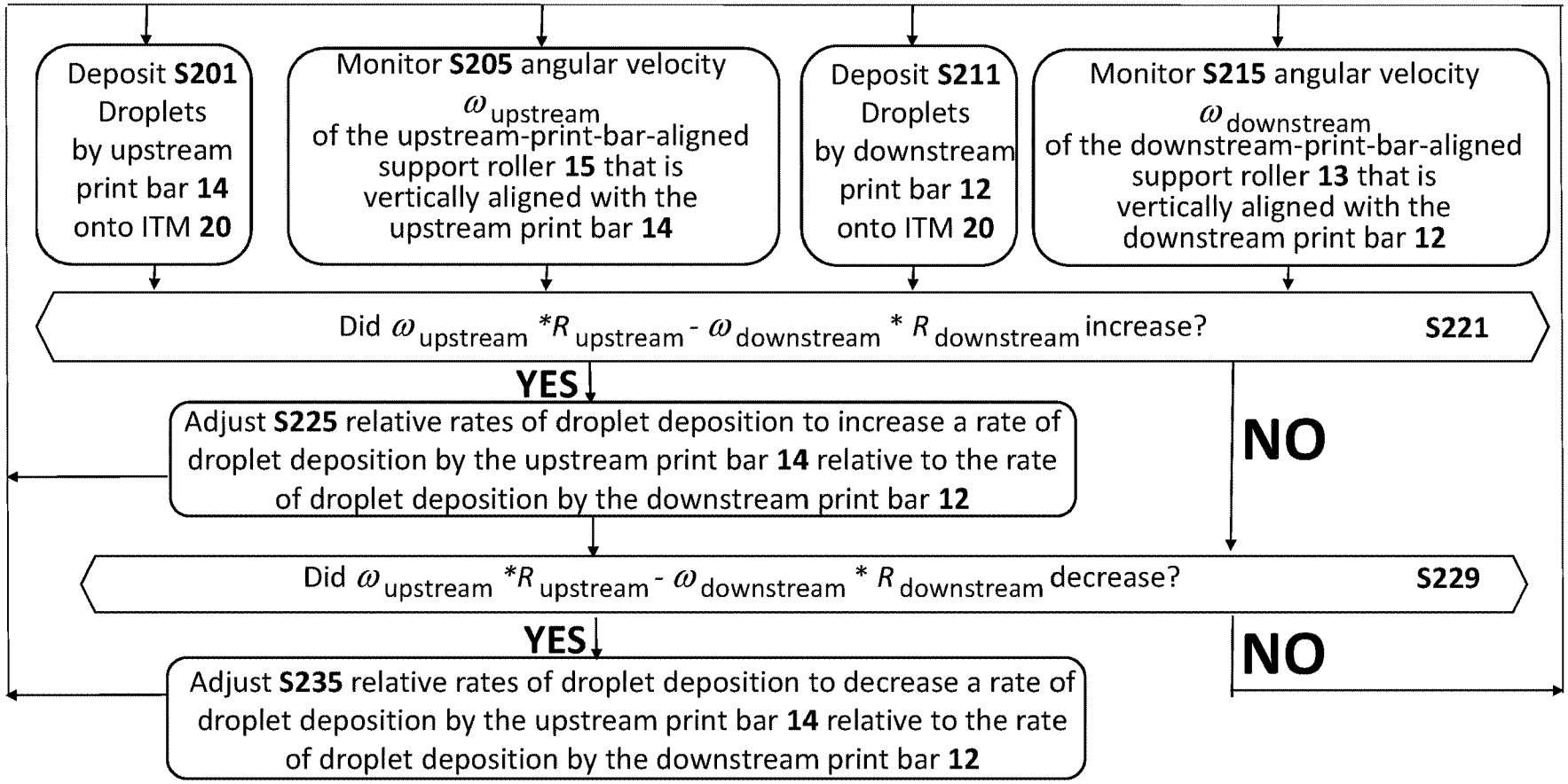

FIG. 8 is another method for depositing ink droplets on ITM 20 where steps S205 and S215 are as in FIGS. 6-7. In steps S201 and S211, droplets are deposited (i.e. at respective deposition rates $DR_{UPSTREAM}$, $DR_{DOWNSTREAM}$) by the upstream 14 and downstream 12 print bars. In steps S221-S225, in response to an increase in $\omega_{upstream}*R_{upstream}-\omega_{downstream}*R_{downstream}$, $DR_{UPSTREAM}-DR_{DOWNSTREAM}$ increases. In steps S229 and S235, in response to a decrease in $\omega_{upstream}*R_{upstream}-\omega_{downstream}*R_{downstream}$, $DR_{UPSTREAM}-DR_{DOWNSTREAM}$ decreases.

According to some embodiments, for upstream 14 and downstream 12 print bars respectively vertically aligned with upstream 15 and downstream 13 support rollers, the droplet-deposition control circuit regulates the respective $DR_{UPSTREAM}$, $DR_{DOWNSTREAM}$ deposition rates at upstream and downstream print bars so that a difference $DR_{UPSTREAM}-DR_{DOWNSTREAM}$ between respective ink-droplet-deposition-rates at upstream and downstream print bars is regulated according to a difference function between function $F=\omega_{UPSTREAM}*R_{UPSTREAM}-\omega_{DOWNSTREAM}*R_{DOWNSTREAM}$ where: i. $\omega_{UPSTREAM}$ is the measured rotation rate of the upstream-printbar-aligned support roller 13 as measured by its associated rotational-velocity measurement device or encoder 213; ii. $R_{UPSTREAM}$ is the radius of the upstream-printbar-aligned support roller 215; iii. $\omega_{DOWNSTREAM}$ is the measured rotation rate of the downstream-printbar-aligned support roller 15 as measured by its associated rotational-velocity measurement device or encoder 215; and ii. $R_{DOWNSTREAM}$ is the radius of the upstream-printbar-aligned support roller 15.

Embodiments of the present invention relate to encoder devices and/or rotational-velocity measurement devices. The rotational-velocity measurement device and/or encoder device may convert the angular position or motion of a shaft or axle to an analog or digital code. The encoder may be an absolute or an incremental (relative) encoder. The encoder may include any combination of mechanical (e.g. including gear(s)) (e.g. stress-based and/or rheometer-based) and/or electrical (e.g. conductive or capacitive) and/or optical and/or magnetic (e.g. on-axis or off-axis—e.g. including a Hall-effect sensor or magnetoresistive sensor) techniques, or any other technique known in the art.

In different embodiments, the measurement device and/or the encoder may be attached (i.e. directly or indirectly attached) to its respective roller.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Presently-disclosed teachings may be practiced in a system that employs water-based ink and an ITM having a hydrophobic outer surface. However, this is not a limitation and other inks or ITMs may be used.

Although the present invention has been described with respect to various specific embodiments presented thereof for the sake of illustration only, such specifically disclosed embodiments should not be considered limiting. Many other alternatives, modifications and variations of such embodiments will occur to those skilled in the art based upon Applicant's disclosure herein. Accordingly, it is intended to embrace all such alternatives, modifications and variations and to be bound only by the spirit and scope of the invention as defined in the appended claims and any change which come within their meaning and range of equivalency.

In the description and claims of the present disclosure, each of the verbs "comprise", "include" and "have", and conjugates thereof, are used to indicate that the object or objects of the verb are not necessarily a complete listing of features, members, steps, components, elements or parts of the subject or subjects of the verb.

As used herein, the singular form "a", "an" and "the" include plural references and mean "at least one" or "one or more" unless the context clearly dictates otherwise.

As used herein, when a numerical value is preceded by the term "about", the term "about" is intended to indicate +/−10%.

To the extent necessary to understand or complete the disclosure of the present invention, all publications, patents, and patent applications mentioned herein, are expressly incorporated by reference in their entirety as is fully set forth herein.

Citation or identification of any reference in this application shall not be construed as an admission that such reference is available as prior art to the invention.

The invention claimed is:

1. An indirect printing system having an intermediate transfer member (ITM) in the form of a circulating endless belt for transporting ink images from an image forming station, where the ink images are deposited on an outer surface of the ITM by at least one print bar, to an impression station where the ink images are transferred from the outer surface of the ITM onto a printing substrate, wherein the outer surface of the ITM is maintained within the image forming station at a predetermined distance from the at least one print bar by a plurality of support rollers that have a common flat tangential plane and contact the inner surface of the ITM, and wherein the inner surface of the ITM is attracted to the support rollers, the attraction being such that the area of contact between the ITM and each support roller is greater on the downstream side than the upstream side of the support roller, referenced to the direction of movement of the ITM, wherein (i) the attraction of the ITM to each support roller is sufficient to cause the section of the ITM disposed immediately downstream of the support roller to be deflected downwards, away from the common tangential plane of the support rollers; (ii) the attraction between the inner surface of the ITM and the support rollers is caused by suction; (iii) a presence of the suction causes the area of contact between the ITM and each support roller to be greater on the downstream side than the upstream side of the support roller, referenced to the direction of movement of the ITM; and (iv) a strength of the suction is sufficient to cause the section of the ITM disposed immediately downstream of the support roller to be deflected downwards, away from the common tangential plane of the support rollers.

2. The indirect printing system as claimed in claim 1, wherein each support roller has a perforated outer surface, communicating with a plenum within the support roller that is connected to a vacuum source.

3. The indirect printing system as claimed in claim 2, wherein a stationary shield surrounds, or lines, part of the circumference of each support roller so that suction is only applied to the side of the roller facing the ITM.

4. The indirect printing system as claimed in claim 1 wherein each print bar is associated with a respective support roller and the position of the associated support roller in relation to the print bar is such that, during operation, ink is deposited by the print bar onto the ITM along a narrow strip upstream from the contact area between the ITM and the support roller.

5. The indirect printing system as claimed in claim 1, wherein a shaft or linear encoder is associated with one or more of the support rollers to determine the position of the ITM in relation to the print bars.

6. The indirect printing system as claimed in claim 1, comprising a plurality of the print bars such that a different respective support roller is located below and vertically aligned with each print bar of the plurality of print bars.

7. The indirect printing system as claimed in claim 6 wherein for each given print bar of the plurality of print bars, a respective vertically-aligned support roller is disposed slightly downstream of the given print bar.

8. The indirect printing system as claimed in claim 6 wherein each given support roller of the plurality of support rollers is associated with a respective rotational-velocity measurement device and/or a respective encoder for measuring a respective rotational-velocity of the given support roller.

9. The indirect printing system of claim 8 further comprising: droplet-deposition control circuitry configured to regulate, for each given print bar of the plurality of print bars, a respective rate of ink droplet deposition DR onto the ITM, the droplet-deposition control circuitry regulating the ink droplet deposition rates in accordance with and in response to the measured of the rotational velocity of a respective support rollers that is vertically aligned with the given print bar.

10. The indirect printing system as claimed in claim 8 wherein for upstream and downstream print bars respectively vertically aligned with upstream and downstream support rollers, the droplet-deposition control circuit regulates the respective $DR_{UPSTREAM}$, $DR_{DOWNSTREAM}$ deposition rates at upstream and downstream print bars so that a difference $DR_{UPSTREAM}-DR_{DOWNSTREAM}$ between respective ink-droplet-deposition-rates at upstream and downstream print bars is regulated according to a difference function between function $F=\omega_{UPSTREAM}*R_{UPSTREAM}-\omega_{DOWNSTREAM}*R_{DOWNSTREAM}$ where: i. $\omega_{UPSTREAM}$ is the measured rotation rate of the upstream-printbar-aligned support roller as measured by its associated rotational-velocity measurement device or encoder; ii. $R_{UPSTREAM}$ is the radius of the upstream-printbar-aligned support roller; iii. $\omega_{DOWNSTREAM}$ is the measured rotation rate of the downstream-printbar-aligned support roller as measured by its associated rotational-velocity measurement device or encoder; and ii. $R_{DOWNSTREAM}$ is the radius of the upstream-printbar-aligned support roller.

11. The indirect printing system as claimed in claim 1, wherein a stationary shield surrounds, or lines, part of the circumference of each support roller so that suction is only applied to the side of the roller facing the ITM.

12. An indirect printing system having an intermediate transfer member (ITM) in the form of a circulating endless belt for transporting ink images from an image forming station, where the ink images are deposited on an outer surface of the ITM by at least one print bar, to an impression station where the ink images are transferred from the outer surface of the ITM onto a printing substrate, wherein the outer surface of the ITM is maintained within the image forming station at a predetermined distance from the at least one print bar by a plurality of support rollers that have a common flat tangential plane and contact the inner surface of the ITM, and wherein the inner surface of the ITM is attracted to the support rollers, the attraction being such that the area of contact between the ITM and each support roller is greater on the downstream side than the upstream side of the support roller, referenced to the direction of movement of the ITM, wherein (i) the attraction of the ITM to each support roller is sufficient to cause the section of the ITM disposed immediately downstream of the support roller to be deflected downwards, away from the common tangential plane of the support rollers; (ii) the attraction between the support rollers and the ITM is a magnetic attraction; (iii) the magnetic attraction causes the area of contact between the ITM and each support roller to be greater on the downstream side than the upstream side of the support roller, referenced to the direction of movement of the ITM; and (iv) a strength of the magnetic attraction is sufficient to cause the section of the ITM disposed immediately downstream of the support roller to be deflected downwards, away from the common tangential plane of the support rollers.

13. An indirect printing system having an intermediate transfer member (ITM) in the form of a circulating endless belt for transporting ink images from an image forming station, where the ink images are deposited on an outer surface of the ITM by at least one print bar, to an impression station where the ink images are transferred from the outer surface of the ITM onto a printing substrate, wherein the outer surface of the ITM is maintained within the image forming station at a predetermined distance from the at least one print bar by a plurality of support rollers that have a common flat tangential plane and contact the inner surface of the ITM, and wherein the inner surface of the ITM is attracted to the support rollers, the attraction being such that the area of contact between the ITM and each support roller is greater on the downstream side than the upstream side of the support roller, referenced to the direction of movement of the ITM, wherein (i) the attraction of the ITM to each support roller is sufficient to cause the section of the ITM disposed immediately downstream of the support roller to be deflected downwards, away from the common tangential plane of the support rollers; and (ii) the attraction between the inner surface of the ITM and the support rollers is caused by suction such that for each given support roller of the plurality of support rollers, a greater suction is applied on downstream side of the given support roller than on an upstream side thereof.

14. The indirect printing system as claimed in claim 13 wherein each print bar is associated with a respective support roller and the position of the associated support roller in relation to the print bar is such that, during operation, ink is deposited by the print bar onto the ITM along a narrow strip upstream from the contact area between the ITM and the support roller.

15. The indirect printing system as claimed in claim 13, wherein a shaft or linear encoder is associated with one or more of the support rollers to determine the position of the ITM in relation to the print bars.

16. The indirect printing system as claimed in claim 13, comprising a plurality of the print bars such that a different respective support roller is located below and vertically aligned with each print bar of the plurality of print bars.

17. The indirect printing system as claimed in claim 16 wherein for each given print bar of the plurality of print bars, a respective vertically-aligned support roller is disposed slightly downstream of the given print bar.

18. The indirect printing system as claimed in claim 16 wherein each given support roller of the plurality of support rollers is associated with a respective rotational-velocity measurement device and/or a respective encoder for measuring a respective rotational-velocity of the given support roller.

19. The indirect printing system of claim 18 further comprising: droplet-deposition control circuitry configured to regulate, for each given print bar of the plurality of print bars, a respective rate of ink droplet deposition DR onto the ITM, the droplet-deposition control circuitry regulating the ink droplet deposition rates in accordance with and in response to the measured of the rotational velocity of a respective support rollers that is vertically aligned with the given print bar.

20. The indirect printing system as claimed in claim 19 wherein for upstream and downstream print bars respectively vertically aligned with upstream and downstream support rollers, the droplet-deposition control circuit regulates the respective $DR_{UPSTREAM}$, $DR_{DOWNSTREAM}$ deposition rates at upstream and downstream print bars so that a difference DR $DR_{UPSTREAM}-DR_{DOWNSTREAM}$ between respective ink-droplet-deposition-rates at upstream and downstream print bars is regulated according to a difference function between function $F=\omega_{UPSTREAM}*R_{UPSTREAM}-\omega_{DOWNSTREAM}*R_{DOWNSTREAM}$ where: i. $\omega_{UPSTREAM}$ is the measured rotation rate of the upstream-printbar-aligned support roller as measured by its associated rotational-velocity measurement device or encoder; ii. $R_{UPSTREAM}$ is the radius of the upstream-printbar-aligned support roller; iii. $\omega_{DOWNSTREAM}$ is the measured rotation rate of the downstream-printbar-aligned support roller as measured by its associated rotational-velocity measurement device or encoder; and ii. $R_{DOWNSTREAM}$ is the radius of the upstream-printbar-aligned support roller.

* * * * *